US005775892A

United States Patent [19]

Miyasaka et al.

[11] Patent Number: 5,775,892

[45] Date of Patent: Jul. 7, 1998

[54] PROCESS FOR ANODIZING ALUMINUM MATERIALS AND APPLICATION MEMBERS THEREOF

[75] Inventors: Hajime Miyasaka; Hideaki Ikeda, both of Sayama, Japan

[73] Assignee: Honda Giken Kogyo Kabushiki Kaisha, Tokyo, Japan

[21] Appl. No.: 621,294

[22] Filed: Mar. 22, 1996

[30] Foreign Application Priority Data

| | | | |
|---|---|---|---|
| Mar. 24, 1995 | [JP] | Japan | 7-065500 |
| Mar. 24, 1995 | [JP] | Japan | 7-065955 |
| Oct. 16, 1995 | [JP] | Japan | 7-267445 |
| Oct. 26, 1995 | [JP] | Japan | 7-279474 |
| Nov. 10, 1995 | [JP] | Japan | 7-292744 |

[51] Int. Cl.[6] ..... C25D 11/06

[52] U.S. Cl. ..... 418/55.2; 123/193.2; 205/50; 205/149; 205/172; 205/173; 205/325; 205/326; 205/332; 428/472.2; 428/667

[58] Field of Search ..... 205/121, 149, 205/153, 172, 173, 325, 332, 326, 50; 418/55.2; 123/193.2; 428/472.2, 667

[56] References Cited

U.S. PATENT DOCUMENTS

| | | | |
|---|---|---|---|
| 3,663,379 | 5/1972 | Kendall | 204/56 |
| 4,188,270 | 2/1980 | Kataoka | 204/42 |
| 4,799,419 | 1/1989 | Krause | 91/499 |
| 4,801,360 | 1/1989 | Tanner | 204/33 |
| 4,898,651 | 2/1990 | Mahmoud | 204/29 |
| 4,970,116 | 11/1990 | Kimura et al. | 428/332 |
| 5,201,646 | 4/1993 | Dees et al. | 418/55.5 |

FOREIGN PATENT DOCUMENTS

| | | |
|---|---|---|
| 6-167243 | 6/1994 | Japan . |
| 2176806 | 1/1987 | United Kingdom . |

OTHER PUBLICATIONS

F.A. Lowenheim, *Electroplating*, McGraw-Hill Book Co., New York, 1978, pp. 89–91.

*Primary Examiner*—Kathryn L. Gorgos
*Assistant Examiner*—William T. Leader
*Attorney, Agent, or Firm*—Merchant, Gould, Smith, Edell, Welter & Schmidt, P.A.

[57] ABSTRACT

According to the present invention, an aluminum alloy containing silicon is anodized using an electrolyte including a compound containing an anion having complexing capability such as sodium hydrogenphosphate or tribasic sodium phosphate, a salt of an organic acid containing an oxyacid anion such as sodium citrate or sodium tartrate or an alcohol such as sorbitol, and a halide such as potassium fluoride or sodium fluoride. The use of such an electrolyte results in a reduced amount of silicon being incorporated in the anodic oxide film. When the resulting oxide film is subjected to an electrodeposition treatment such as electroplating or electrolytic coloring, wasteful consumption of electrodeposition current can be inhibited. An aluminum alloy decorative cover is produced by buffing the surface of an aluminum alloy containing silicon, forming the anodized film on the buffed surface, and subjecting the anodized film to sequential nickel and chromium plating. The anodizing process of the invention for anodizing an aluminum alloy containing silicon is used to anodize a spiral scroll member of a compressor and the inner circumferential surface of the cylinder of a cylinder block.

11 Claims, 16 Drawing Sheets

PROCESS FOR ANODIZING ALUMINUM MATERIALS AND APPLICATION MEMBERS THEREOF

BACKGROUND OF THE INVENTION

1. Filed of the Invention

The present invention relates to an improvement of a technique of subjecting aluminum materials containing Si, particularly cast-forging aluminum alloy containing a large amount of Si, Cu, Fe, etc. to an anodizing treatment, and to an application member subjected to the treatment, e.g. decorative cover for motorbike, scroll member for compressor which is used for a compressor of an air-conditioner, or cylinder block for internal combustion engine.

2. Description of the Related Art

For example, "Sliding Member of Engine Cylinder" of a Japanese Patent Laid-Open Publication HEI 6-167243 discloses the invention that relates to a treatment of Si contained in an aluminum matrix. That is, when an aluminum material containing 8 to 12% of Si is subjected to an anodizing treatment according to a normal controlled DC current electrolysis process in a sulfuric acid bath, Si inhibits a plating current from passing through the material. As a result, a thin and soft film is merely obtained. Thus, according to the invention disclosed in Japanese Patent Laid-Open Publication HEI 6-167243, U.S. Pat. No. 4,801,360 and GB2,176,806A, Si is shattered by using a current inversion process to improve a current-flow, thereby obtaining a thick and hard film.

According to the above technique, needle Si can be ground by shattering, however, Si particles remain in the matrix and oxide film as a matter of course. Therefore, the corrosion resistance of the oxide film is deteriorated, and it is not preferable.

Regarding an aluminum alloy decorative cover used for the motorbike, it is necessary to make the surface smooth and lustrous because the appearance is considered to be important.

FIG. 18 is a flow chart illustrating steps of the surface treatment of a conventional aluminum alloy decorative cover. In FIG. 18, ST indicates a step number. In these treating steps, the surface of the decorative cover is buffed in ST100 after the aluminum alloy decorative cover is subjected to die casting. Then, the decorative cover is subjected to a decreasing treatment of removing grease from the surface of the decorative cover in ST101.

Then, the surface of the decorative cover is subjected to alkaline etching and mixed acid etching to remove Si from the surface of the decorative cover in ST102. The decorative cover is subjected to a first zinc substitution treatment to form a Zn substrate on the surface of the decorative cover in ST103. Thereafter, the decorative cover is subjected to a nitric acid dipping treatment to peel off the Zn film in ST104, and then subjected to a second zinc substitution treatment to form a Zn substrate in ST105. Then, the surface of the Zn substrate is subjected to Ni plating in ST106. Finally, the surface of the Ni plating film is subjected to Cr plating in ST107.

However, when the surface of the decorative cover is buffed in ST100, a chilled layer quenched at the time of casting of the decorative cover is removed to expose a porosity in the vicinity of the chilled layer, sometimes. In addition, even when the porosity is not exposed at the time of buffing, the porosity is exposed by the alkaline etching or mixed acid etching which is conducted after buffing, sometimes.

In such way, when the porosity is exposed on the surface of the decorative cover, the porosity can not be sufficiently filled up even when subjecting to Ni plating or Cr plating in the post-step.

FIGS. 19A and 19B are graphs illustrating a porosity distribution of a conventional aluminum alloy decorative cover, and the coordinate indicates a diameter of an equivalent circle of the porosity. The term "equivalent circle diameter of the porosity" of the coordinate used herein means a diameter of an equivalent circle of the porosity which is determined by the image-analysis of the shape of the porosity detected by an infiltration detecting process after buffing the surface of the aluminum alloy decorative cover. In addition, the broken line is a visual borderline indicating a limitation wherein the porosity can be visually confirmed. When the equivalent circle diameter of the porosity exceeds the visual borderline, it is judged to be defective. On the other hand, when the equivalent circle diameter of the porosity is below the visual borderline, it is judged to be non-defective. This visual borderline locates slightly below the equivalent circle diameter 100 μm of the porosity. In addition, the region Z provided with a hatching is a part where the porosity can be visually observed. Further, the decorative cover is obtained by molding a cast aluminum alloy containing 11% Si.

FIG. 19A illustrates a porosity distribution after buffing, and the abscissa indicates the number of the porosity of the surface of the decorative cover after buffing. As is apparent from the graph, the porosity distribution of the decorative cover after buffing shows a peak at the visual borderline of about 100 μm. The majority of the porosities are in the defective state.

FIG. 19B illustrates a porosity distribution after subjected to a Cr plating treatment, and the abscissa indicates the number of the porosity of the surface of the decorative cover after subjecting to the Cr plating treatment. As is apparent from the graph, the porosity distribution of the decorative cover after subjecting to the Cr plating treatment shows a peak at the visual borderline of about 40 μm. As described above, the porosity can not be sufficiently filled according to a conventional treating process. The amount of the porosity in the non-defective state becomes large, but the porosity in the defective state also exist.

In addition, a scroll type compressor used for air-conditioner, etc., is equipped with a pair of spiral scroll members sliding while contacting each other. Various processes for surface treatment have been suggested in order to prevent respective sliding surfaces of a pair of spiral scroll members from seizing and scratching.

In the process for surface treatment suggested in Japanese Patent Publication SHO 63-32992 "Scroll Type Compressor for automobile air conditioning", for example, an anodized film is formed only on any one of the sliding surface of a pair of spiral scroll members while the sliding surface of the other scroll member exposes the aluminum substrate.

As described above, by forming the anodized film only on one sliding surface, other scroll member can be deformed to escape when the sliding surface of one scroll member and that of the other scroll member are slid while contacting each other.

Thereby, it is possible to prevent seizing of the sliding surface which arises when both sliding surfaces of a pair of scroll members are not subjected to an anodizing treatment. In addition, it is possible to exclude a scratch of the anodized film which arises when both sliding surfaces of a pair of scroll members are subjected to the anodizing treatment.

By the way, it has recently been requested to replace a flon gas for refrigeration medium used for an automobile air-conditioner in view of the environment of the earth. Therefore, it has been requested to increase an output of a scroll type compressor for air conditioning and a strength of a scroll member.

As described above, Japanese Patent Laid-Open Publication HEI 6-167243 discloses that Si is shattered to improve a current-flow, thereby obtaining a thick and hard film. Si can be ground by shattering by this process, but Si particles remain in the matrix and anodized film. Therefore, the oxide film has a problem of seizing, and it is not preferred.

When the inner circumferential surface of cylinder of a cylinder block for an internal combustion engine is made of an aluminum material, the inner circumferential surface of cylinder is subjected to Ni/SiC composite plating so as to maintain the hardness, sliding properties, wear resistance and heat absorbability of the inner circumferential surface of the cylinder.

FIG. 20 is a flow chart illustrating steps of the surface treatment of a conventional inner circumferential surface of cylinder. In these treating steps, the cylinder block for an internal combustion engine of an aluminum alloy is subjected to die casting, and then subjected to a decreasing treatment of removing grease from the inner circumferential surface of cylinder in the step (hereinafter abbreviated to "ST") 200. The cylinder block is subjected to an etching treatment and a Si dissolution treatment in ST201 and ST202, and then subjected to a first zinc substitution treatment in ST203 to form a Zn substrate on the cylinder inner surface. It is subjected to a nitric acid dipping treatment in ST204 to dissolve the Zn substrate, and then subjected to a second zinc substitution treatment in ST205 to form a Zn substrate. Then, the surface of the Zn substrate is subjected to Ni/SiC composite plating in ST106 (FIG. 18)

However, this plating process has a lot of treating steps such as 7 steps and, therefore, the cost is high. In addition, adhesive properties of Ni/SiC composite plating of ST106 change with each product. Furthermore, when a porosity is formed on the inner circumferential surface of the die cast cylinder, the porosity can not be filled by this plating process. Therefore, the porosity can be remained as a pit on the plated surface. Accordingly, when an engine is operated in this state, sticking and bias wear of a piston ring can arise. In addition, peeling of the plating film and pressure leak can arise.

SUMMARY OF THE INVENTION

It is therefore a first object of the present invention is to provide a technique capable of preventing Si of the matrix from being incorporated or remaining in the anodized film, or of removing it to the extent where no influence is exerted.

Another object of the present invention is to provide a process for surface treatment of an aluminum material containing little impurities such as Si, wherein upon subjecting an anodic oxidation film containing little impurities such as Si to an electrodeposition treatment, current losses can be suppressed and the efficiency of the electrodeposition treatment can be increased.

A third object of the present invention is to provide an aluminum alloy decorative cover capable of filling a porosity exposed on the surface of the decorative cover.

A fourth object of the present invention is to provide a scroll member for a compressor which has high strength and is superior in seizing properties.

A fifth object of the present invention is to provide a cylinder block for an internal combustion engine capable of reducing the number of steps of the treatment, inhibiting an influence of Si to improve adhesive properties of the resulting plating film, and smoothing the cylinder inner surface because of it's excellent hole fill characteristics.

In a first aspect of the present invention, there is provided a process in which an aluminum material containing Si is subjected to an anodizing treatment using an electrolyte including the following components:

(1) compound containing an anion having complexing capability;

(2) organic acid containing an oxyacid anion; and (3) halide.

The term "complexing capability" used herein means capable of coordinating as a ligand on a metal ion to form a complex.

The term "complex" used herein means an atomic group formed by bonding an atom of a metal or metallic element as a center atom with the other atom or atomic group, i.e. ligand.

The term "anion" used herein means an anion.

The compound containing an anion having complexing capability is at least one sort selected from sodium hydrogenphosphate and tribasic sodium phosphate. The organic acid containing an oxyacid anion is at least one sort selected from sodium citrate, sodium tartrate and sorbitol. The halide is at least one sort selected from potassium fluoride and sodium fluoride.

A desired oxide film is formed on the surface of an aluminum material by anodizing the aluminum material using an electrolyte including the above components (1) to (3).

In this case, the components (1) to (3) in the electrolyte have the following action, respectively.

The oxyacid anion (2) supplies an OH- ion to an anode to improve a formation efficiency of the film.

The halide (3) selectively dissolves inclusions (e.g. Si, etc.), additive metals and intermetallic compounds, together with the oxyacid anion, to remove them from the oxide film.

The compound (1) containing an anion having complexing capability has an action of smoothing the oxide film. That is, when the oxide film has a concave-convex part on the outer surface in the process of forming, the compound containing an anion adheres thickly to the concave part, and adheres thinly to the convex part. The eluation rate of an Al ion is slow at the concave part and fast at the convex part, seemingly. Therefore, the outer surface of the oxide film is smoothed.

Further, specified compounds of the above components (1) to (3) and their preferable concentration ranges are as follows.

(1) Compound containing an anion having complexing capability

Preferable compound: sodium hydrogenphosphate, tribasic sodium phosphate

Preferable concentration: sodium hydrogenphosphate (0.2 to 0.5 mol), tribasic sodium phosphate (0.2 to 0.4 mol)

When the amount is less than the lower limit, the formation rate of the oxide film becomes slow (e.g. 0.01 μm/minute), which results in deterioration of productivity. On the other hand, when the amount exceeds the upper limit, the compound is precipitated in the bath due to supersaturation to make no sense.

(2) Organic acid containing an oxyacid anion

Preferable compound: sodium citrate, sodium tartrate, sorbitol

Preferable concentration: sodium citrate (0.1 to 0.75 mol), sodium tartrate (0.1 to 0.55 mol), sorbitol (0.25 to 0.75 mol)

When the amount is less than the lower limit, the film-forming effect is lost. On the other hand, when the amount exceeds the upper limit, a burning arises to terminate the growth of the film.

(3) Halide

Preferable compound: potassium fluoride, sodium fluoride

Preferable concentration: potassium fluoride (0.1 to 0.75 mol), sodium fluoride (0.1 to 0.75 mol)

When the amount is less than the lower limit, the residual amount of the alloying component becomes too large. On the other hand, when the amount exceeds the upper limit, the growth of the film is terminated.

In a second aspect of the present invention, there is provided a process for surface treatment of an aluminum material, the process comprising: a first step of subjecting the aluminum material to an anodizing treatment using an electrolyte including the above-described compound containing an anion having complexing capability, organic acid containing an oxyacid anion, and halide as the components (1) to (3), and a second step of subjecting the resulting oxide film to an electrodeposition treatment due to one sort selected from electroplating, dip plating and electrolytic coloring or a combination thereof.

The treatment in the above second step is a sealing treatment and, therefore, a microhole formed by the anodizing treatment as the first step is sealed.

The oxide film obtained in the first step contains a little impurity such as Si, etc., and the amount of the impurity becomes so small that an electrolysis of water using Si as an electrode can be ignored. Therefore, a wasteful consumption of the current in the electroplating can be inhibited and the treating efficiency of the second step becomes high.

In a third aspect of the present invention, there is provided a process for making a decorative cover for a motorbike using an aluminum material containing Si, the process comprising the steps of: buffing the surface of the aluminum material; forming an anodized film on the buffed surface using an electrolyte including the above compound containing an anion having complexing capability, organic acid containing an oxyacid anion, and halide as the components (1) to (3); subjecting the anodized film to Ni plating; and subjecting the surface of the Ni plating film to Cr plating.

As described above, when anodizing with the electrolyte of the above components (1) to (3), a desired anodized film can be formed on the surface of the decorative cover of the aluminum alloy containing Si due to actions of the components (1) to (3) in the electrolyte.

Since the treatment of subjecting the anodized film to Ni plating, and subjecting the surface of the Ni plating film to Cr plating is a sealing treatment, a microhole formed on the anodized film of the prestep is sealed.

In this case, the anodized film contains a little Si, and the amount of Si becomes so small that an electrolysis of water using Si as an electrode can be ignored. Therefore, a wasteful consumption of the current in the electroplating can be inhibited and the treating efficiency of the second step becomes high.

In a fourth aspect of the present invention, there is provided a scroll member for a compressor, which compresses a fluid by relatively rotating a pair of spiral scroll members, produced by making the spiral scroll member using an aluminum material containing Si, and forming an anodized film on the surface of the spiral scroll member using an electrolyte of the above compound containing an anion having complexing capability, organic acid containing an oxyacid anion, and halide as the components (1) to (3).

As described above, when anodizing with the electrolyte of the above components (1) to (3), a desired anodized film can be formed on the surface of the scroll member of the aluminum alloy containing Si due to actions of the components (1) to (3) in the electrolyte.

The fifth aspect of the present invention is a cylinder for an internal combustion engine, comprising a cylinder block wherein the inner circumferential surface of cylinder is made of an aluminum material containing Si, an anodized film formed on the inner circumferential surface of the cylinder using an electrolyte including the above compound containing an anion having complexing capability, organic acid containing an oxyacid anion and halide as the components (1) to (3), and a Ni/SiC plating film provided on the anodized film. Thereby, the number of steps of the surface treatment can be reduced and, therefore, adhesive properties of the plating film can be improved.

As described above, when anodizing with the electrolyte of the above components (1) to (3), a desired anodized film can be formed on the surface of the cylinder block for internal combustion engine of the aluminum alloy containing Si due to actions of the components (1) to (3) in the electrolyte.

Since the treatment of subjecting the anodized film to Ni/SiC plating is a sealing treatment, a microhole formed on the anodized film of the prestep is sealed.

In this case, the anodized film is also formed in the interior of the porosity and contains a little Si, and the amount of Si becomes so small that an electrolysis of water using Si as an electrode can be ignored. Therefore, a wasteful consumption of the current in the electroplating can be inhibited. Accordingly, the Ni/SiC plating film is also formed in the interior of the porosity to fill the porosity.

BRIEF DESCRIPTION OF THE DRAWINGS

The present invention will now be explained in detail with reference to the accompanying drawings, in which.

DETAILED DESCRIPTION OF THE INVENTION

Figure 1:
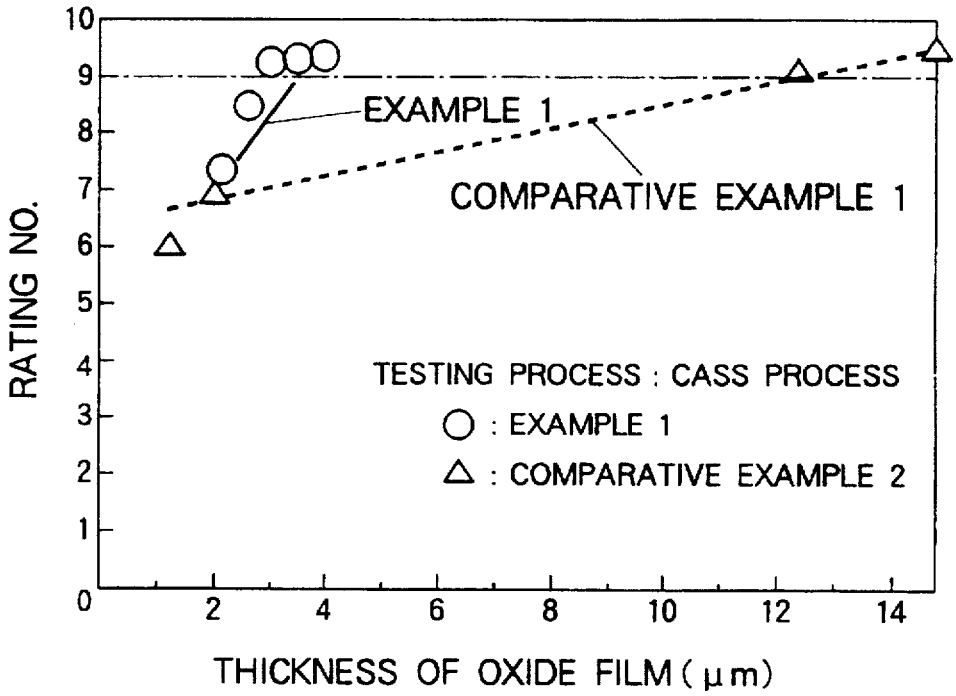
FIG. 1 is a graph illustrating a relationship between the thickness of the oxide film and rating No. of samples obtained in Example 1 according to the process of the present invention and Comparative Example 1.

The following Examples and Comparative Examples further illustrate the present invention in detail but are not to be construed to limit the scope thereof.

Table 1 shows the conditions of the pretreatment for the following Examples and Comparative Examples. That is, a matrix (aluminum material) is subjected to a treatment of removing grease from the surface before subjecting to an anodizing treatment.

TABLE 1

| pretreatment | |
|---|---|
| treating process | electrodegreasing |
| electrolyte | 15 wt % sulfuric acid, 20° C. |
| voltage | −5 V |
| operation time | 2 min |

Example 1 and Comparative Example 1

The matrix of Example 1 and Comparative Example 1 is ADC12-JIS H5302 as a die cast aluminum alloy containing 1.5 to 3.5 wt % Cu, 9.6 to 12.0 wt % Si and 0.3 to 0.6 wt % Fe, a main component of which is as shown in Table 2.

TABLE 2

| | (wt %) | | | | |
|---|---|---|---|---|---|
| | Cu | Si | Fe | Mg, Zn, Mn Ni, Sn | Al |
| ADC12-JISH5302 | 1.5~3.5 | 9.6~12.0 | 0.3~0.6 | trace or 0 | balance |

In Example 1, the material ADC12-JIS subjected to the above pretreatment was anodized using an electrolyte of tribasic sodium phosphate (0.3 mol), sorbitol (0.5 mol) and potassium fluoride (0.5 mol) as shown in Table 3. The solution temperature was 20° C. and voltage was 50 V (DC). In addition, the operation time was changed within a range of 20 to 90 minutes to obtain six samples. Furthermore, these samples were allowed to stand in hot water in which a commercially available sealing agent was added at 95° C. for 20 minutes, followed by washing with water and further air drying to obtain samples.

TABLE 3

| | example 1 | comparative example 1 |
|---|---|---|
| matrix | ADC12-JIS | ADC12-JIS |
| electrolyte | | |
| component | tribasic sodium phosphate: 0.3 mol<br>sorbitol: 0.5 mol<br>potassium fluoride: 0.5 mol | 15 wt % sulfuric acid |
| solution temperature | 20° C. | 20° C. |
| voltage | 50 V | 15 V |
| operation time | 20~90 min | 10~60 min |
| oxide film | | |
| thickness corresponding to rating No. 9 | 3.5 μm | 13 μm |
| Si content | 5 wt % | 11 wt % |

FIG. 1 is a graph illustrating a relationship between the thickness of the oxide film and rating No. of samples obtained in Example 1 according to the process of the present invention and Comparative Example 1.

The term "rating No." used herein means an index of the corrosion resistance defined in a CASS process which is one of a testing method defined in JIS (Japanese Industrial Standard) H8681 "Corrosion Resistance Testing Method of Anodized Film of Aluminum and Aluminum Alloy".

The CASS process is a method comprising spraying a sample with an aqueous saline solution containing a copper salt (acidified with acetic acid) for a predetermined time, using a CASS testing device, and examining the corrosion resistance by the state of corrosion. In the Examples and Comparative Examples, the time of the CASS test was set at 16 hours.

The rating No. 10 means that no corrosion arises, the rating No. 9.5 means that a corrosion area is not more than 0.05%, and the rating No. 9 means that a corrosion area is not more than 0.10%. After the rating No. 9, the smaller the rating No., the larger the corrosion area becomes. That is, the larger the rating No., the better the corrosion resistance becomes. It is said that the rating No. which stands normal use is 9 and, therefore, a standard rating No. was set at 9 in the present invention.

Six samples obtained by the process of Example 1 were subjected to the CASS test, and the results are shown in FIG. 1 using a symbol (○). As a result, it has been found that the thickness of the oxide film satisfying the rating No. 9 may be 3 to 4 μm. In addition, the component of the oxide film was analyzed by EPMA (X-ray analyzer). As a result, the Si content was 8 wt %.

In Comparative Example 1, the material ADC12-JIS subjected to the above pretreatment was anodized using the electrolyte of 15 wt % sulfuric acid as shown in Table 3. The solution temperature was 20° C. and voltage was 10 V (DC). In addition, the operation time was changed within a range of 10 to 60 minutes to obtain five samples. Furthermore, these samples were allowed to stand in hot water in which a commercially available sealing agent was added at 95° C. for 20 minutes, followed by washing with water and further air drying to obtain samples.

These samples were subjected to the CASS test, and the results are shown in FIG. 1 using a symbol (Δ). As a result, it has been found that the thickness of the oxide film satisfying the rating No. 9 is 13 μm. In addition, the component of the oxide film was analyzed by EPMA (X-ray analyzer). As a result, the Si content was 17 wt %.

It can be said that the sample of Example 1 (having about one-fourth of a film thickness of the sample of Comparative Example 1) exhibits the same corrosion resistance as that of Comparative Example 1. It is considered that this difference depends on the amount of Si (8 wt % for Example 1, 17 wt % for Comparative Example 1) contained in the oxide film.

Example 2 and Comparative Example 2

The matrix of Example 2 and Comparative Example 2 is AC4C-JIS H5202 as a cast aluminum alloy containing not more than 0.05 wt % Cu, 6.5 to 7.5 wt % Si, 0.3 to 0.45 wt % Mg, not more than 0.3 wt % Fe and not more than 0.2 wt % Ti, a main component of which is as shown in Table 4.

TABLE 4

| | (wt %) | | | | | | |
|---|---|---|---|---|---|---|---|
| | Cu | Si | Mg | Fe | Ti | Zn, Mn, Ni Pb, Sn, Cr | Al |
| AC4C JISH5202 | 0.05 OR LESS | 6.5~7.5 | 0.3~0.45 | 0.30 or less | 0.20 or less | trace or 0 | balance |

In Example 2, the material AC4C-JIS subjected to the above pretreatment was anodized using the electrolyte including tribasic sodium phosphate (0.3 mol), sorbitol (0.5 mol) and potassium fluoride (0.5 mol) as shown in Table 5. The solution temperature was 20° C. and voltage was 50 V (DC). In addition, the operation time was changed within a range of 20 to 60 minutes to obtain six samples. Furthermore, these samples were allowed to stand in hot water in which a commercially available sealing agent was added at 95° C. for 20 minutes, followed by washing with water and further air drying to obtain samples.

TABLE 5

| | example 2 | comparative example 2 |
|---|---|---|
| matrix | AC4C-JIS | AC4C-JIS |
| electrolyte | | |
| component | tribasic sodium phosphate: 0.3 mol sorbitol: 0.5 mol potassium fluoride: 0.5 mol | 15 wt % sulfuric acid |
| solution temperature | 20° C. | 20° C. |
| voltage | 50 V | 15 V |
| operation time | 20~60 min | 10~60 min |
| oxide film | | |
| thickness corresponding to rating No. 9 | 3 μm | 13 μm |
| Si content | 5 wt % | 11 wt % |

Figure 2:
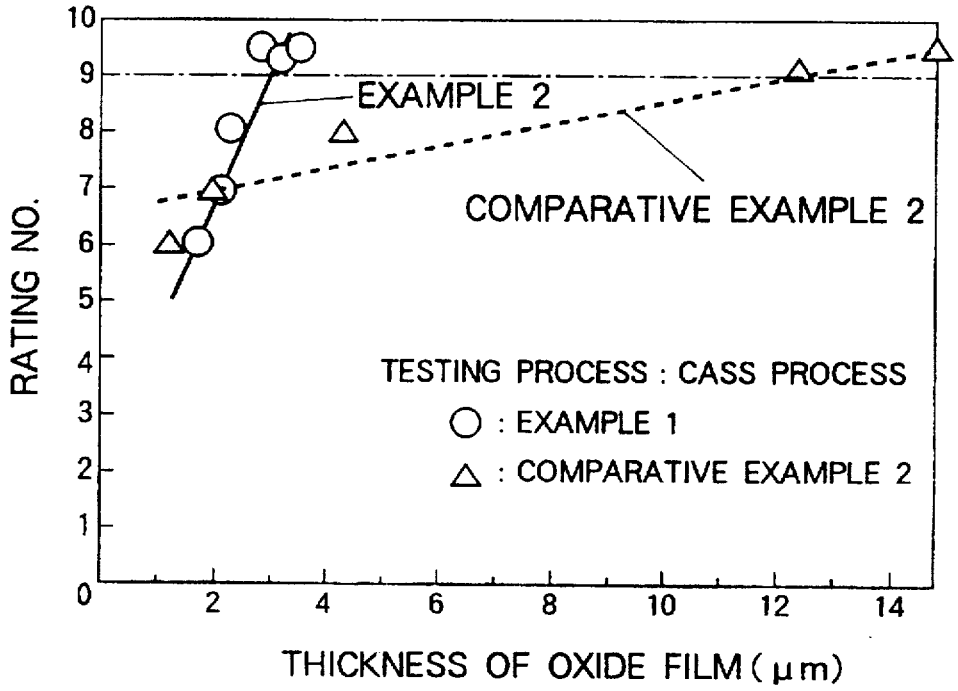
FIG. 2 is a graph illustrating a relationship between the thickness of the oxide film and rating No. of samples obtained in Example 2 according to the process of the present invention and Comparative Example 2.

FIG. 2 is a graph illustrating a relationship between the thickness of the oxide film and rating No. of samples obtained in Example 2 according to the process of the present invention and Comparative Example 2.

Six samples obtained by the process of Example 2 were subjected to the CASS test, and the results are shown in FIG. 2 using a symbol (○). As a result, it has been found that the thickness of the oxide film satisfying the rating No. 9 may be 3 μm. In addition, the component of the oxide film was analyzed by EPMA. As a result, the Si content was 7 wt %.

In Comparative Example 2, the material AC4C subjected to the above pretreatment was anodized using the electrolyte of 15 wt % sulfuric acid as shown in Table 5. The solution temperature was 20° C. and voltage was 15 V (DC). In addition, the operation time was changed within a range of 10 to 60 minutes to obtain five samples. Furthermore, these samples were allowed to stand in hot water in which a commercially available sealing agent was added at 95° C. for 20 minutes, followed by washing with water and further air drying to obtain samples.

These samples were subjected to the CASS test, and the results are shown in FIG. 2 using a symbol (Δ). As a result, it has been found that the thickness of the oxide film satisfying the rating No. 9 is 13 μm.

It can be said that the sample of Example 2 (having about one-fourth of a film thickness of the sample of Comparative Example 2) exhibits the same corrosion resistance as that of Comparative Example 2. It is considered that this difference depends on the amount of Si (7 wt % for Example 2, 17 wt % for Comparative Example 1) contained in the oxide film.

Example 3, Example 4 and Comparative Example 3

The matrix of Example 3, Example 4 and Comparative Example 3 is ADC12-JIS H5302 as a die cast aluminum alloy shown in Table 2.

In Example 3, the material ADC12-JIS subjected to the above pretreatment was anodized using the electrolyte comprising tribasic sodium phosphate (0.2 mol), sorbitol (0.5 mol) and potassium fluoride (0.5 mol) as shown in Table 6. The solution temperature was 20° C. and voltage was 50 V (DC). In addition, the operation time was changed within a range of 20 to 90 minutes to obtain five samples. Furthermore, these samples were allowed to stand in hot water in which a commercially available sealing agent was added at 95° C. for 20 minutes, followed by washing with water and further air drying to obtain samples.

TABLE 6

| | example 3 | example 4 | comparative example 3 |
|---|---|---|---|
| matrix | ADC12-JIS | ADC12-JIS | ADC12-JIS |
| electrolyte | | | |
| component | tribasic sodium phosphate: 0.2 mol sorbitol: 0.5 mol potassium fluoride: 0.5 mol | tribasic sodium phosphate: 0.3 mol sodium tartrate: 0.3 mol sodium fluoride: 0.3 mol | 15 wt % sulfuric acid |
| solution temperature | 20° C. | 20° C. | 20°/C. |
| voltage | 50 V | 50 V | 15 V |
| operation time | 30 min | 30 min | 10~60 min |
| oxide film | | | |
| thickness corresponding to rating No. 9 | 2.5 μm | 4 μm | 14 μm |
| Si content | 5 wt % | 6 wt % | 11 wt % |

Figure 3:
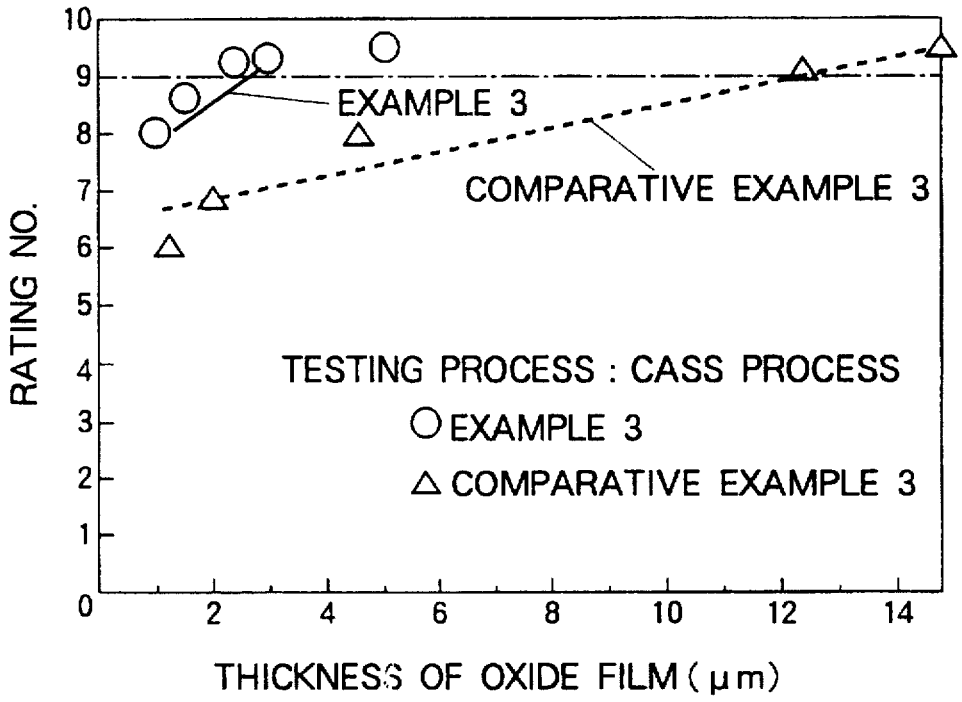
FIG. 3 is a graph illustrating a relationship between the thickness of the oxide film and rating No. of samples obtained in Example 3 according to the process of the present invention and Comparative Example 3.

FIG. 3 is a graph illustrating a relationship between the thickness of the oxide film and rating No. of samples obtained in Example 3 according to the process of the present invention and Comparative Example 3.

Five samples obtained by the process of Example 3 were subjected to the CASS test, and the results are shown in FIG. 3 using a symbol (○). As a result, it has been found that the thickness of the oxide film satisfying the rating No. 9 may be 2.5 μm. In addition, the component of the oxide film was analyzed by EPMA. As a result, the Si content was 7 wt %.

In Comparative Example 3, the material ADC12 subjected to the above pretreatment was anodized using the electrolyte of 15 wt % sulfuric acid as shown in Table 6. The solution temperature was 20° C. and voltage was 15 V (DC). In addition, the operation time was changed within a range of 10 to 60 minutes to obtain five samples. Furthermore, these samples were allowed to stand in hot water in which a commercially available sealing agent was added at 95° C. for 20 minutes, followed by washing with water and further air drying to obtain samples.

These samples were subjected to the CASS test, and the results are shown in FIG. 3 using a symbol (Δ). As a result, it has been found that the thickness of the oxide film satisfying the rating No. 9 is 13 μm.

It can be said that the sample of Example 3 (having about one-fourth of a film thickness of the sample of Comparative Example 3) exhibits the same corrosion resistance as that of Comparative Example 3. It is considered that this difference depends on the amount of Si (7 wt % for Example 3, 17 wt % for Comparative Example 3) contained in the oxide film.

In Example 4, the material ADC12-JIS subjected to the above pretreatment was anodized using the electrolyte including tribasic sodium phosphate (0.3 mol), sodium tartrate (0.3 mol) and potassium fluoride (0.3 mol) as shown in Table 6. The solution temperature was 20° C. and voltage was 50 V (DC). In addition, the operation time was changed within a range of 20 to 90 minutes to obtain four samples. Furthermore, these samples were allowed to stand in hot water in which a commercially available sealing agent was added at 95° C. for 20 minutes, followed by washing with water and further air drying to obtain samples.

Figure 4:
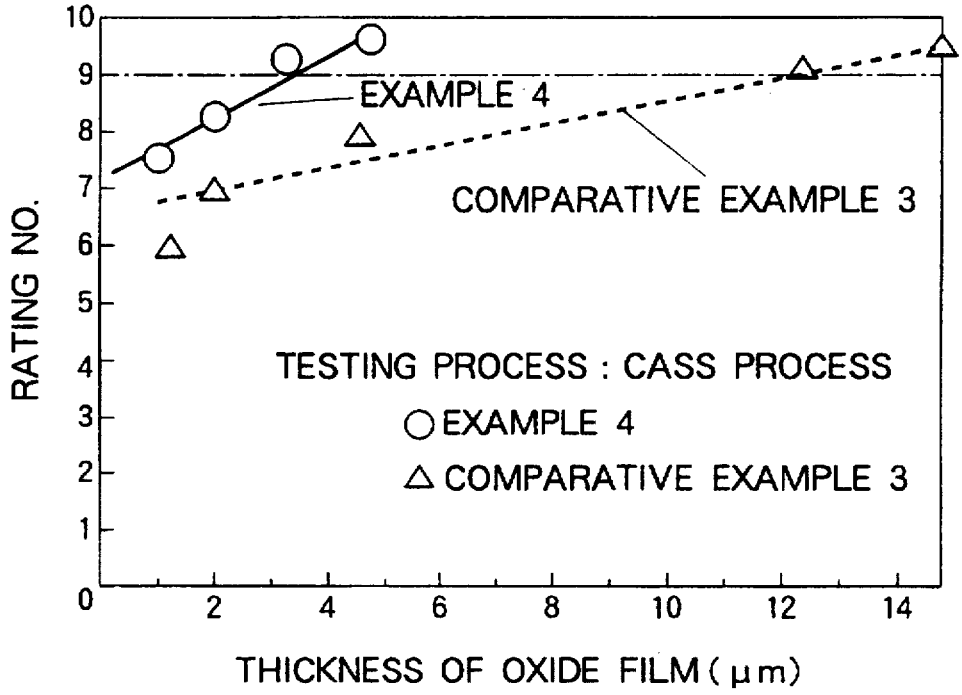
FIG. 4 is a graph illustrating a relationship between the thickness of the oxide film and rating No. of samples obtained in Example 4 according to the process of the present invention and Comparative Example 3.

FIG. 4 is a graph illustrating a relationship between the thickness of the oxide film and rating No. of samples obtained in Example 4 according to the process of the present invention and Comparative Example 3.

Four samples obtained by the process of Example 4 were subjected to the CASS test, and the results are shown in FIG. 4 using a symbol (○). As a result, it has been found that the thickness of the oxide film satisfying the rating No. 9 may be 4 μm. In addition, the component of the oxide film was analyzed by EPMA. As a result, the Si content was 8 wt %.

Comparative Example 3 shown in FIG. 4 is the same as that of FIG. 3, and the thickness of the oxide film satisfying the rating No. 9 is 13 μm.

It can be said that the sample of Example 4 (having about one-third of a film thickness of the sample of Comparative Example 3) exhibits the same corrosion resistance as that of Comparative Example 3. It is considered that this difference depends on the amount of Si (8 wt % for Example 4, 17 wt % for Comparative Example 3) contained in the oxide film.

As is apparent from the above fact, the electrolyte in the present invention has an action of dissolving Si which transfers from the matrix to the oxide film, seemingly, and, therefore, the Si content in the oxide film is reduced and the corrosion resistance is improved.

Further, the electrolyte in the present invention dissolves not only Si but also alloying metals (e.g. Cu, Fe, etc.) and other intermetallic compounds and, therefore, the oxide film can be improved.

However, the process of the present invention can be applied to the anodizing treatment of the aluminum material containing a comparatively small amount of an alloying component.

As described above, according to the present invention, the aluminum material containing Si is subjected to the anodizing treatment using the electrolyte comprising the compound (1) containing an anion having complexing capability, organic acid (2) containing an oxyacid anion, and halide (3). The halide (3) selectively dissolve inclusions (e.g. Si, etc.), additive metals and intermetallic compounds, together with the oxyacid anion (2), to remove them from the oxide film. Therefore, the corrosion resistance of the oxide film is extremely improved. In addition, the compound (1) containing an anion having complexing capability has an action of smoothing the oxide film. That is, when the oxide film has a concave-convex part on the outer surface in the process of forming, the compound containing an anion adheres thickly to the concave part, and adheres thinly to the convex part. The eluation rate of an Al ion is slow at the concave part and fast at the convex part, seemingly. Therefore, the outer surface of the oxide film is smoothed.

In the process of the present invention, at least one sort selected from sodium hydrogenphosphate and tribasic sodium phosphate, at least one sort selected from sodium citrate, sodium tartrate and sorbitol and at least one sort selected from potassium fluoride and sodium fluoride were used as the compound containing an anion having complexing capability, organic acid containing an oxyacid anion and halide, respectively, and, therefore, these compounds can be easily selected and changed within the specified item. Accordingly, the preparation becomes simple and treating operation becomes efficient.

Example 5 and Comparative Example 4

The matrix of Example 5 and Comparative Example 4 is ADC12-JIS H5302 as a die cast aluminum alloy containing 1.5 to 3.5 wt % Cu, 9.6 to 12.0 wt % Si and 0.3 to 0.6 wt % Fe, a main component of which is as shown in Table 2.

In Example 5, the material ADC12-JIS subjected to the above pretreatment was anodized as the first step using an electrolyte including tribasic sodium phosphate (0.3 mol), sorbitol (0.5 mol) and potassium fluoride (0.5 mol) as shown in Table 7. The solution temperature was 20° C. and voltage was 50 V (DC). In addition, the operation time was 60 minutes.

TABLE 7

| | example 5 | comparative example 4 |
|---|---|---|
| matrix | ADC12-JI6 | ADC12-JIS |
| anodizing treatment | | |
| component of electrolyte | tribasic sodium phosphate: 0.3 mol<br>sorbitol: 0.5 mol<br>potassium fluoride: 0.5 mol | 15 wt % sulfuric acid |
| solution temperature | 20° C. | 20° C. |
| voltage | 50 V | 15 V |
| operation time | 60 min | 30 min |
| electroplating | | |
| plating solution | nickel sulfate: 70 g/l<br>boric acid: 30 g/l | nickel sulfate: 70 g/l<br>boric acid: 30 g/l |
| counter electrode | carbon plate | carbon plate |
| voltage | AC 10 V (50 Hz) | AC 10 V (50 Hz) |
| treating time | 20 min | 20 min |
| plating film | formed | not formed |

The resulting oxide film was subjected to electroplating as the second step. A mixed solution of nickel sulfate (70 g/l) and boric acid (30 g/l) was used as the plating solution as shown in Table 7, and a carbon plate was used as the counter electrode. It was treated by applying an AC voltage of 10 V (50 Hz) for 20 minutes. Then, an elemental analysis (Ni) of the surface film was conducted. As a result, nickel was detected and the formation of the plating film was confirmed.

In Comparative Example 4, the material ADC12-JIS subjected to the above pretreatment was subjected to an anodizing treatment (first step) using 15 wt % sulfuric acid as shown in Table 7, and then subjected to the same electroplating as that of Example 5 in the second step. The elemental analysis (Ni) of the resulting surface film was conducted. As a result, nickel was not detected and the formation of the plating film was not observed.

Examples 6 and 7

According to the same manner as that described in Example 5 except for changing the components of the electrolyte for anodizing treatment in the first step, the test was conducted.

In Example 6, the first step was conducted by using a mixed solution of sodium hydrogenphosphate (0.2 mol), sorbitol (0.5 mol) and potassium fluoride (0.5 mol) as the electrolyte, and then the second step which is the same as that of Example 5 was conducted. As a result, the formation of the nickel-plating film was observed.

TABLE 8

| | example 6 | comparative example 7 |
|---|---|---|
| matrix | ADC12-JIS | ADC12-JIS |
| anodizing treatment | | |
| component of electrolyte | sodium hydrogenphosphate: 0.2 mol<br>sorbitol: 0.5 mol<br>potassium fluoride: 0.5 mol | sodium hydrogenphosphate: 0.2 mol<br>sodium tartrate: 0.3 mol<br>sodium fluoride: 0.3 mol |
| solution temperature | 20° C. | 20° C. |
| voltage | 50 V | 50 V |
| operation time | 60 min | 60 min |
| electroplating | | |
| plating solution | nickel sulfate: 70 g/l<br>boric acid: 30 g/l | nickel sulfate: 70 g/l<br>boric acid: 30 g/l |
| counter electrode | carbon plate | carbon plate |
| voltage | AC 10 V (50 Hz) | AC 10 V (50 Hz) |
| treating time | 20 min | 20 min |
| plating film | formed | formed |

In Example 7, the first step 1 was conducted by using a mixed solution of sodium hydrogenphosphate (0.2 mol), sodium tartrate (0.3 mol) and potassium fluoride (0.3 mol) as the electrolyte as shown in Table 8, and then the second step which is the same as that of Example 5 was conducted. As a result, the formation of the nickel plating film was observed. Accordingly, a good plating film was observed by the above three sorts of electrolytes.

Example 8 and Comparative Example 5

In Example 8 and Comparative Example 5, a two-stage electroplating is conducted in the second step.

In Example 8, the material ADC12-JIS subjected to the above pretreatment was subjected to anodizing as the first step, using an electrolyte including tribasic sodium phosphate (0.3 mol), sorbitol (0.5 mol) and potassium fluoride (0.5 mol) as shown in Table 9. The solution temperature was 20° C. and voltage was 50 V (DC). In addition, the operation time was 60 minutes.

TABLE 9

| | example 8 | comparative example 5 |
|---|---|---|
| matrix | ADC12-JIS | ADC12-JIS |
| anodizing treatment | | |
| component of electrolyte | tribasic sodium phosphate: 0.3 mol<br>sorbitol: 0.5 mol<br>potassium fluoride: 0.5 mol | 15 wt % sulfuric acid |
| solution temperature | 20° C. | 20° C. |
| voltage | 50 V | 15 V |
| operation time | 60 sec | 30 sec |
| electroplating (first layer) | | |
| strike bath | nickel chloride: 80 g/l | nickel chloride: 80 g/l |
| plating solution | hydrochloric acid: 150 ml/l | hydrochloric acid: 150 ml/l |
| current density | 5 A/dm$^2$ | 5 A/dm$^2$ |

TABLE 9-continued

| | example 8 | comparative example 5 |
|---|---|---|
| operation time | 60 sec | 60 sec |
| electroplating (second layer) | | |
| watt bath | nickel sulfate: 200 g/l | nickel sulfate: 200 g/l |
| plating solution | nickel chloride: 45 g/l<br>boric acid: 35 g/l | nickel chloride: 45 g/l<br>boric acid: 35 g/l |
| current density | 2.5 A/dm$^2$ | 2.5 A/dm$^2$ |
| operation time | 30 min | 30 min |
| plating film | formed | not formed |
| evaluation test | a cycle (heating to 200° C., maintaining at the same temperature for 30 minutes, followed by water cooling) was repeated 20 times | |
| judgment | no peeling and blister, good | |

The resulting oxide film is subjected to the two-stage electroplating as the second step.

In the first stage, the plating was conducted in a strike bath under the following condition as shown in Table 9. That is, a mixed solution of nickel chloride (80 g/l) and hydrochloric acid (150 ml/l) was used as the plating solution and current density was 5 A/dm$^2$. In addition, the operation time was 60 seconds.

In the second stage, the plating was conducted in a watt bath under the following condition. A mixed solution of nickel sulfate (200 g/l), nickel chloride (45 g/l) and boric acid (35 g/l) was used as the plating solution and current density was 2.5 A/dm$^2$. In addition, the operation time was 30 minutes.

The resulting plating film was repeatedly subjected to a heating/cooling cycle (heating to 200 ° C. and maintaining at the same temperature for 30 minutes→water cooling→heating to 200 ° C. and maintaining at the same temperature for 30 minutes→water cooling) 20 times. As a result, no peeling or blisters were observed, and adhesive properties were good.

According to the same manner as that described above except for using those of Examples 6 and 7 in place of the electrolyte in the first step, the test was conducted. As a result, the results were similarly good.

Comparative Example 5 differs from Example 8 only in using 15 wt % sulfuric acid as the electrolyte in the first step. However, the formation of the plate film was not observed after subjecting to the second-stage electroplating. Accordingly, the process of the present invention is also effective for the two-stage electroplating process.

Example 9 and Comparative Example 6

In Example 9 and Comparative Example 6, an electrolytic coloring is conducted in the second step.

In Example 9, the material ADC12-JIS subjected to the above pretreatment was subjected to anodizing as the first step, using an electrolyte including tribasic sodium phosphate (0.3 mol), sorbitol (0.5 mol) and potassium fluoride (0.5 mol) as shown in Table 10. The solution temperature was 20° C. and voltage was 50 V (DC). In addition, the operation time was 30 minutes.

TABLE 10

| | example 9 | comparative example 6 |
|---|---|---|
| matrix | ADC12-JIS | ADC12-JIS |
| anodizing treatment | | |
| component of electrolyte | tribasic sodium phosphate: 0.3 mol<br>sorbitol: 0.5 mol<br>potassium fluoride: 0.5 mol | 15 wt % sulfuric acid |
| solution temperature | 20° C. | 20° C. |
| voltage | 50 V | 15 V |
| operation time | 30 min | 30 min |
| electrolytic coloring | | |
| solution | cobalt sulfate: 0.2 mol<br>boric acid: 0.3 mol | cobalt sulfate: 0.2 mol<br>boric acid: 0.3 mol |
| counter electrode | carbon plate | carbon plate |
| operation time | 5 min at AC 10 V | 5 min at AC 10 V |
| coloring | black | not colored |

The resulting oxide film is subjected to the electrolytic coloring as the second step. It was treated by applying an AC voltage of 10 V (50 Hz) for 5 minutes under the following condition as shown in Table 10. That is, a mixed solution of cobalt sulfate (0.2 mol) and boric acid (0.3 mol) was used as the solution and a carbon plate was used as the counter electrode.

As a result, a black colored film was observed on the surface.

In Comparative Example 6, the material ADC12-JIS subjected to the above pretreatment was subjected to an anodizing treatment (first step) using 15 wt % sulfuric acid as shown in Table 10, and then the same electrolytic coloring as that of Example 9 was conducted in the second step.

However, no coloring was observed on the surface.

Example 10 and Comparative Example 7

In Example 10 and Comparative Example 7, a second-stage dip plating and a single-stage electroplating are conducted in the second step.

In Example 10, the material ADC12-JIS subjected to the above pretreatment was subjected to anodizing as the first step, using an electrolyte including tribasic sodium phosphate (0.3 mol), sodium tartrate (0.3 mol) and potassium fluoride (0.3 mol) as shown in Table 11. The solution temperature was 20° C. and voltage was 40 V (DC). In addition, the operation time was 30 minutes. The film thickness of the oxide film was about 4 μm.

TABLE 11

| | example 10 | comparative example 7 |
|---|---|---|
| matrix | ADC12-JIS | ADC12-JIS |
| anodizing treatment | | |
| component of electrolyte | tribasic sodium phosphate: 0.3 mol<br>sodium tartrate: 0.3 mol<br>potassium fluoride: 0.3 mol | 15 wt % sulfuric acid |
| solution | 20° C. | 20° C. |
| voltage | 40 V | 15 V |
| operation time | 30 min | 30 min |
| dip plating (first time) | | |
| plating solution | 0.1% stannous chloride solution | 0.1% stannous chloride solution |

TABLE 11-continued

| | example 10 | comparative example 7 |
|---|---|---|
| dipping time | 30 sec | 30 sec |
| dip plating (second time) | | |
| plating solution | 0.1% palladium chloride solution | 0.1% palladium chloride solution |
| dipping time | 30 sec | 30 sec |
| electroplating | | |
| watt bath plating solution | nickel sulfate: 200 g/l nickel chloride: 45 g/l boric acid: 30 g/l | nickel sulfate: 200 g/l nickel chloride: 45 g/l boric acid: 30 g/l |
| current density | 2.5 A/dm$^2$ | 2.5 A/dm$^2$ |
| operation time | 60 min | 60 min |
| plating film | formed | not formed |
| evaluation (corrosion resistance) | | |
| process | JIS H8681 CASS test, 16 hours | JIS H8681 CASS test, 16 hours |
| presults | rating NO. 9.5 | rating NO. 7.0 |
| judgment | ○ | x |

The resulting oxide film is subjected to the two-stage dip plating then to the single-stage electroplating as the second step.

The plating in the first stage was conducted under the condition as shown in Table 11. That is, a 0.1% stannous chloride solution was used as the plating solution and the dipping time was 30 seconds. The dip plating in the second stage was conducted under the following condition. That is, a 0.1% palladium chloride solution was used as the plating solution and the dipping time was 30 seconds.

Furthermore, the plating was conducted in a watt bath under the following condition. A mixed solution of nickel sulfate 200 g/l), nickel chloride (45 g/l) and boric acid (30 g/l) was used as the plating solution and the current density was 2.5 A/dm$^2$. In addition, the operation time was 60 minutes. Furthermore, the resultant was allowed to stand in a hot water in which a commercially available sealing agent was added at 95° C. for 20 minutes, followed by washing with water and further air drying to obtain a sample.

The resulting plating film was subjected to a corrosion resistance test according to a CASS process to determine a rating No.

According to the CASS process, the rating No. of Example 10 was 9.5. As a result, the corrosion resistance was extremely good.

Comparative Example 7 differs from Example 10 only in changing the electrolyte in the first step to 15 wt % sulfuric acid. The rating No. according to the CASS process was 7.0. As a result, the corrosion resistance was not good.

As is apparent from the above results of the respective Examples, the anodized film obtained in the first step contains a little impurity (e.g. Si, etc.), and the amount of the impurity becomes so small that an electrolysis of water using Si as an electrode can be ignored in the electrodeposition process of the second step. Therefore, a wasteful consumption of the current in the electroplating can be inhibited and the treating efficiency of the second step becomes high.

As described above, according to the present invention, the aluminum material containing Si is subjected to the anodizing treatment using the electrolyte including the compound (1) containing an anion having complexing capability, organic acid (2) containing an oxyacid anion, and halide (3). Therefore, the halide (3) selectively dissolves inclusions (e.g. Si, etc.), additive metals and intermetallic compounds, together with the oxyacid anion (2), to remove them from the oxide film. Therefore, the corrosion resistance of the oxide film is extremely improved. In addition, the compound (1) containing an anion having complexing capability has an action of smoothing the oxide film. That is, when the oxide film has a concave-convex part on the outer surface in the process of forming, the compound containing an anion adheres thickly to the concave part, and adheres thinly to the convex part. The eluation rate of an Al ion is slow at the concave part and fast at the convex part, seemingly. Therefore, the outer surface of the oxide film is smoothed.

Since the anodized film containing a little impurity (e.g. Si, etc.) is subjected to the electrodeposition process in the second step, the amount of the impurity becomes so small that an electrolysis of water using Si as an electrode can be ignored in the electrodeposition process of the second step. Therefore, a wasteful consumption of the current in the electroplating can be inhibited and the treating efficiency of the second step becomes high.

In the process of the present invention, at least one sort selected from sodium hydrogenphosphate and tribasic sodium phosphate, at least one sort selected from sodium citrate, sodium tartrate and sorbitol and at least one sort selected from potassium fluoride and sodium fluoride were used as the compound containing an anion having complexing capability, organic acid containing an oxyacid anion, respectively and, therefore, these compounds can be easily selected and changed within the specified item. Accordingly, the preparation becomes simple and treating operation becomes efficient.

Next, a motorbike using an aluminum alloy decorative cover will be explained.

Figure 5:
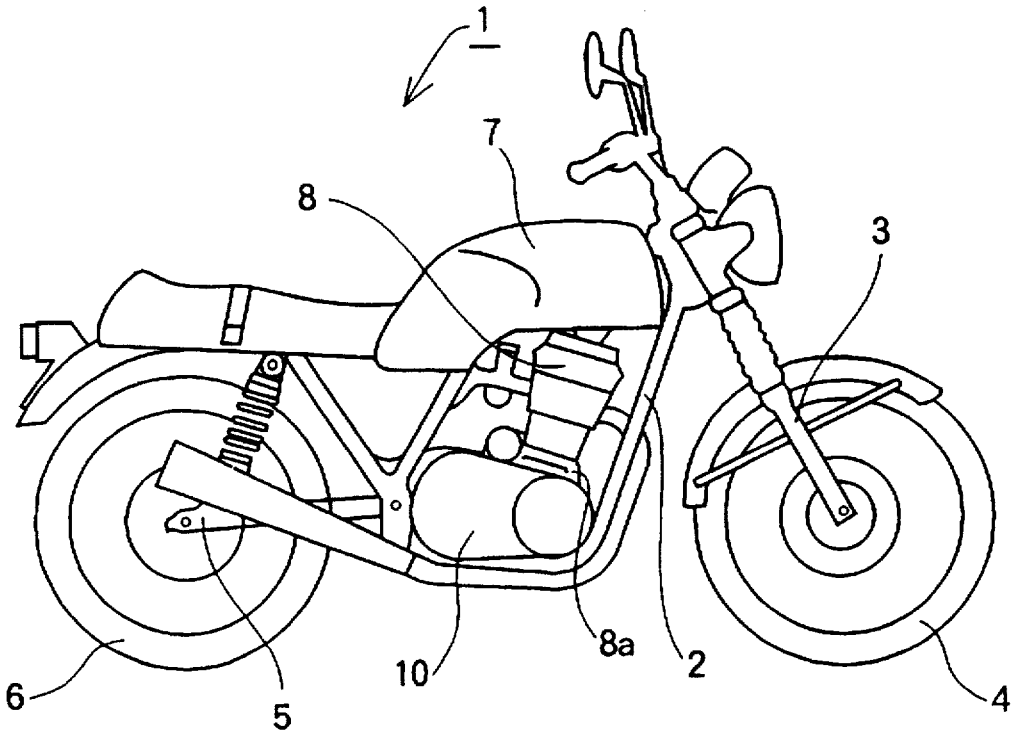
FIG. 5 is a side view illustrating a motorbike using the aluminum alloy decorative cover of the present invention.

In FIG. 5, a motorbike 1 is equipped with a body frame 2, a front fork 3 provided at the front end of the body frame 2, a front wheel 4 mounted to the front fork 3, a swing arm 5 provided at the rear end of the body frame 2, a rear wheel 6 mounted to the swing arm 5, a fuel tank 7 provided at the upper end of the frame body 2 and an engine 8 provided in the center of the frame body 2. A crankcase cover 10 (only one side is shown) as the aluminum alloy decorative cover of the present invention was mounted to both side parts of a crankcase 8*a* of the engine 8.

Figure 6:
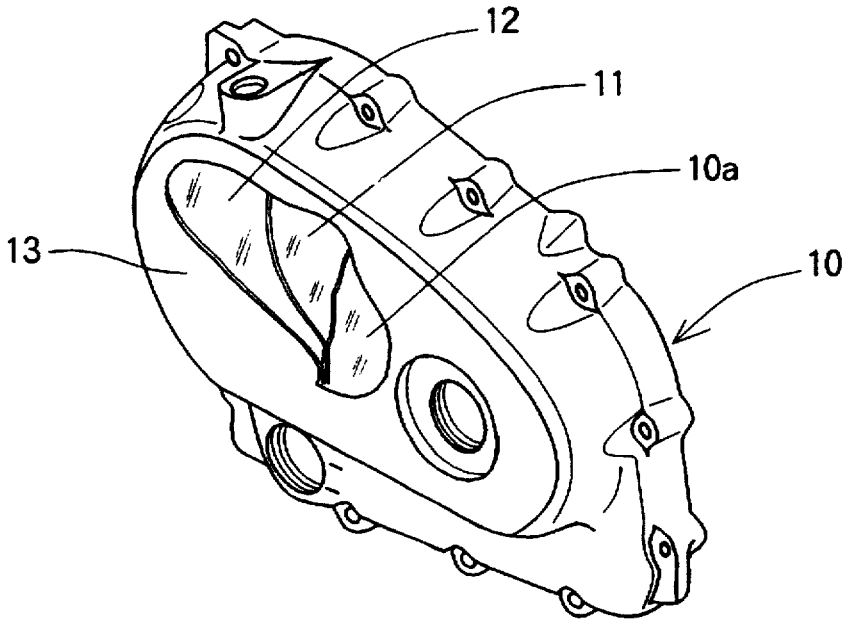
FIG. 6 is a perspective view illustrating the aluminum alloy decorative cover of the present invention.

FIG. 6 is a perspective view of the aluminum alloy decorative cover (crankcase cover) of the present invention, and illustrates the state where an anodized film 11, a Ni plating film 12 and a Cr plating film 13 are laminated in this order on a buffed die cast surface 10*a* of the crankcase cover 10.

Next, a process for providing the above anodized film 11, Ni plating film 12 and Cr plating film 13 on the surface of the crankcase cover 10 will be explained.

Figure 7:
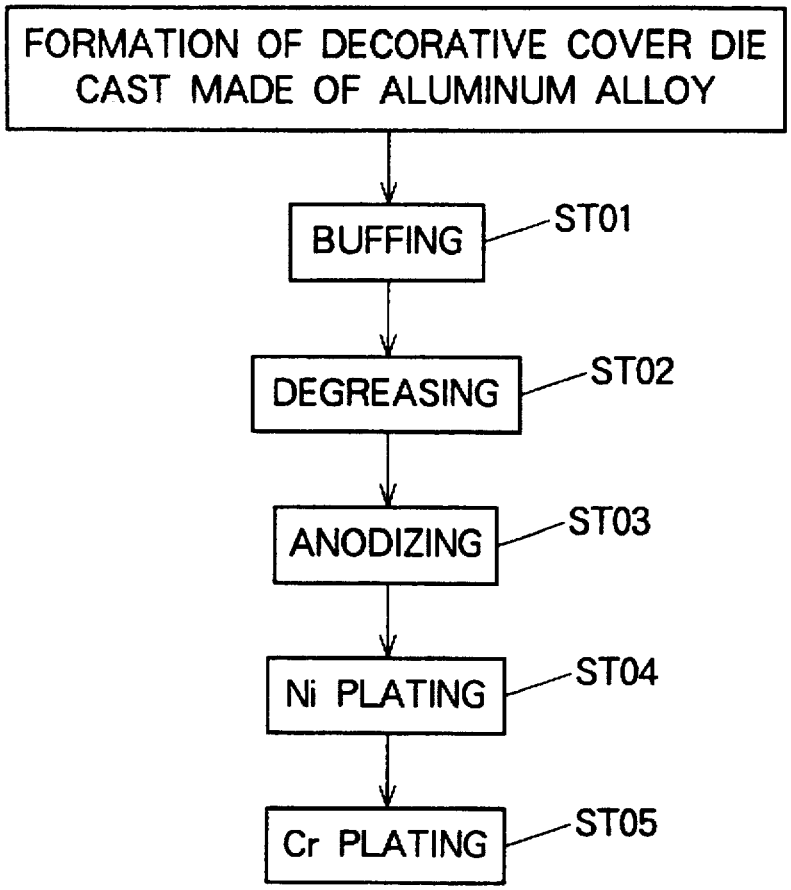
FIG. 7 is a flow chart illustrating steps of a surface treatment of the crankcase cover of the present invention.

FIG. 7 is a flow chart illustrating steps of the surface treatment of the crankcase cover of the present invention. In FIG. 7, ST indicates a step. After the aluminum alloy decorative cover is subjected to die casting, the surface of the decorative cover is buffed in ST01. After grease is removed from the surface of the decorative cover in ST02, the die cast surface 10*a* buffed in ST03 is subjected to an anodizing treatment. The surface of the anodized film is subjected to Ni-plating in ST04, and then the surface of the Ni plating film is subjected to Cr plating in ST05.

The above-described pretreatment of Table 1 corresponds to ST02 of FIG. 7, and it is a treatment of removing grease from the surface of the matrix (aluminum material).

Example 11 and Comparative Example 8

The matrix of Example 11 and Comparative Example 8 is ADC12-JIS H5302 as a die cast aluminum alloy containing 1.5 to 3.5 wt % Cu, 9.6 to 12.0 wt % Si and 0.3 to 0.6 wt % Fe, a main component of which is as shown in Table 2.

In Example 11, the material ADC12-JIS H5302 subjected to the above pretreatment was anodized as shown in ST03 of FIG. 7 using an electrolyte including tribasic sodium phosphate (9 wt % ), sorbitol (5 wt %) and potassium fluoride (3 wt %) as shown in Table 12. The solution temperature was 20° C. and voltage was 50 V (DC). In addition, the operation time was 30 minutes.

TABLE 12

Figure 18:
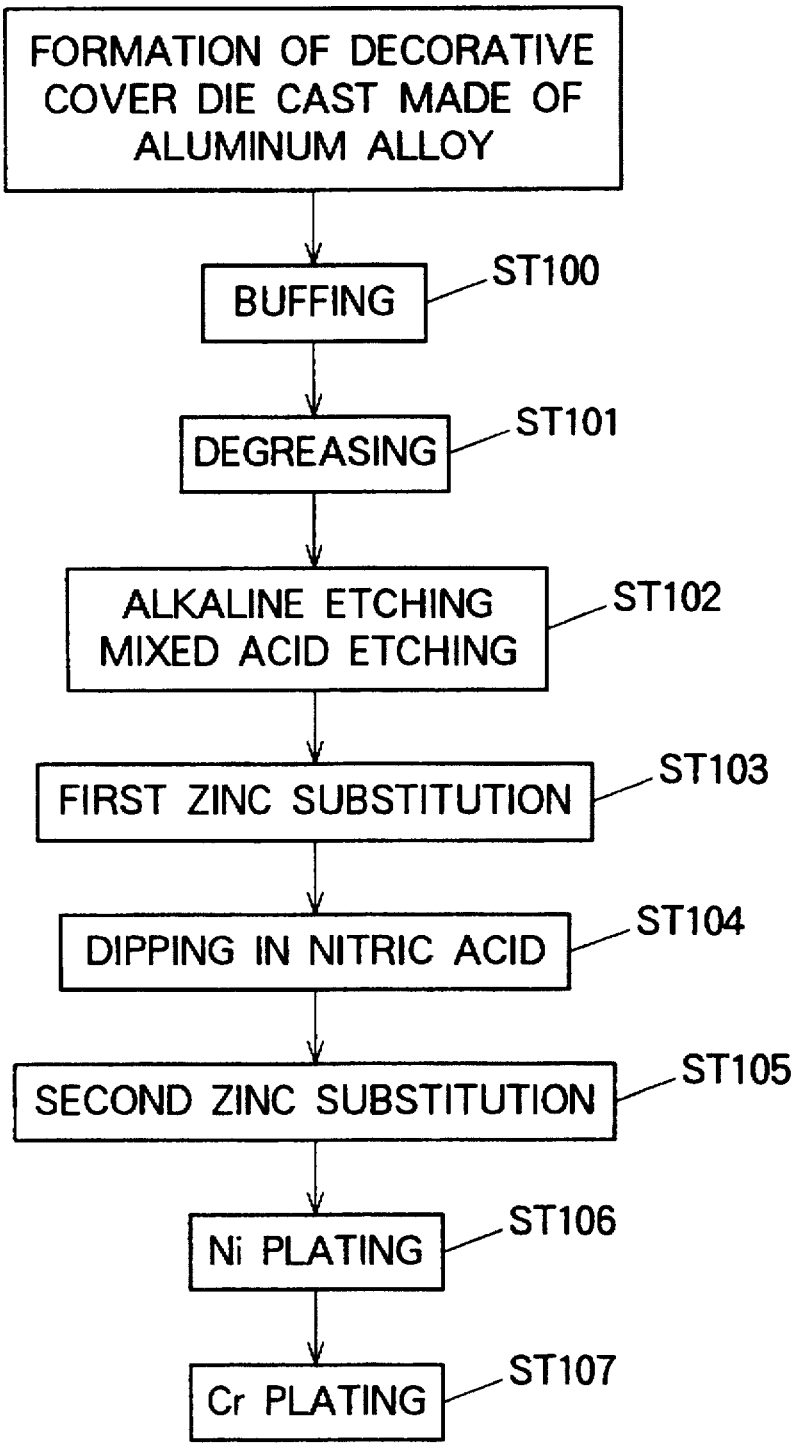
FIG. 18 is a flow chart illustrating steps of the surface treatment of a conventional aluminum alloy decorative cover.

| | example 11 | comparative example 8 |
|---|---|---|
| matrix | ADC12-JISH5302 | ADC12-JISH5302 |
| component of electrolyte | tribasic sodium phosphate: 9 wt % sorbitol: 5 wt % potassium fluoride: 3 wt % | first and second zinc substitutions are conducted after etching by a conventional treating process of FIG. 18 |
| solution temperature | 20° C. | |
| voltage | 50 V | |
| operation time | 30 min | |
| pretreatment of plating aqueous dipping solution (dipping time) | stannous chloride (4 wt %) (30 minutes) palladium chloride (0.03 wt %) (30 minutes) | — |
| Ni plating treatment | watt bath current density: 1.8 A/dm$^2$ treating time: 1 hour | watt bath current density: 1.8 A/dm$^2$ treating time: 1 hour |
| Cr plating | ○ | ○ |

After the completion of the anodizing treatment, the material was respectively dipped in an aqueous solution of stannous chloride (4 wt %) and an aqueous solution of palladium chloride (0.03 wt %) for 30 seconds, as a pretreatment of the plating. Then, as shown in ST04 of FIG. 7, it was subjected to Ni plating (current density: 1.8 A/dm$^2$) in a watt bath for one hour. Then, as shown in ST05 of FIG. 7, the surface of the Ni plating film was subjected to Cr plating.

In Comparative Example 8, according to the same manner as that of the prior art, the surface of the decorative cover of the material ADC12-JIS was subjected to alkaline etching and mixed acid etching to remove Si from the surface of the decorative cover, and then subjected to a first zinc substitution treatment. Thereafter, harmful Si was removed by subjecting to a nitric acid dipping treatment, and then a Zn substrate was formed by subjecting to a second zinc substitution treatment. According to the same manner as that described in Example 11, the decorative cover was subjected to Ni plating (current density: 1.8 A/dm$^2$) in a watt bath for one hour, and then subjecting the surface of the Ni plating film to Cr plating.

Figure 8:
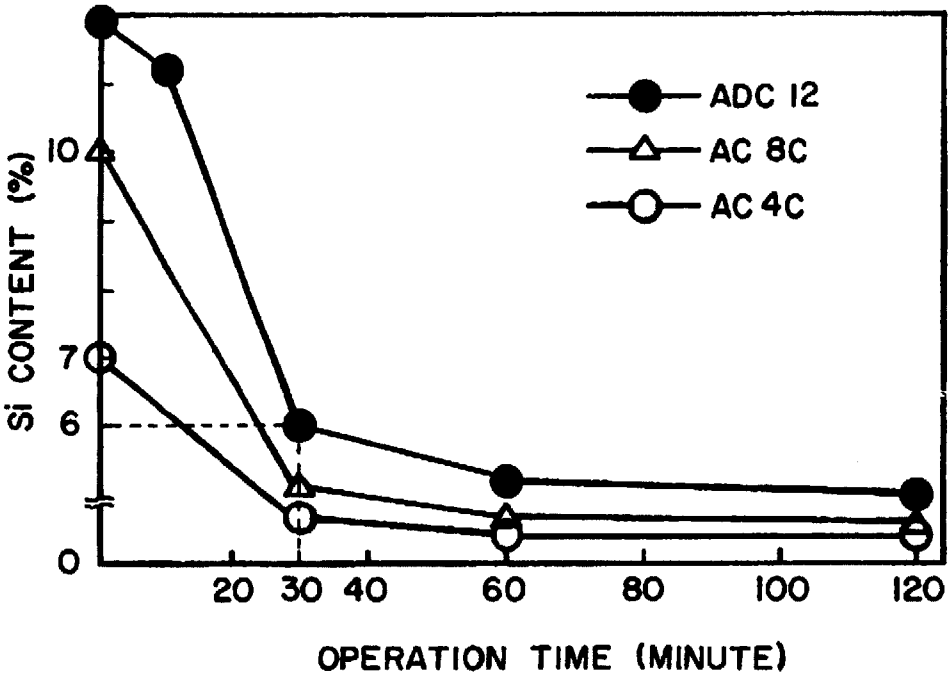
FIG. 8 is a graph illustrating a relation between the time of the anodizing treatment and Si content of the decorative cover.

FIG. 8 is a graph illustrating a relationship between the time of the anodizing treatment and Si content of the decorative cover, and the coordinate and abscissa indicate the Si content and time of the anodizing treatment, respectively. In addition, ●,Δ and ○ indicate the material ADC12-JIS, AC8C-JIS and AC4C-JIS, respectively. As is apparent from FIG. 8, the Si content decreases as the time of the anodizing treatment increases. For example, when the material ADC12-JIS is subjected to the anodizing treatment for 30 minutes according to the same manner as that described in Table 12, the Si content of the material ADC12-JIS decreases to about 6%. In case of the material AC8C-JIS and AC4C-JIS, the Si content decreases to about 6% or less.

Figure 9A:
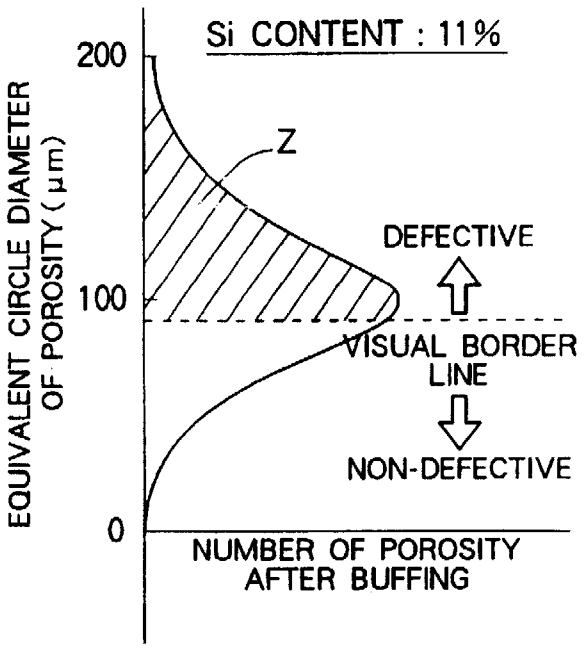
FIGS. 9A to 9C are graphs illustrating a porosity distribution of the aluminum alloy decorative cover of the present invention.
Figure 9B:
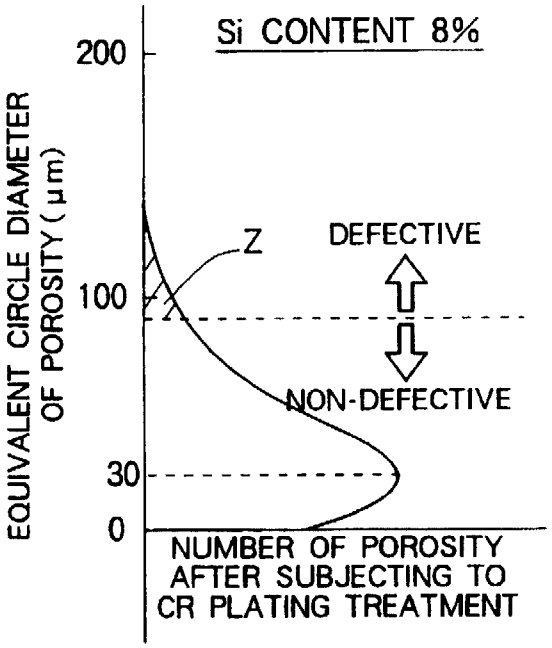
Figure 9C:
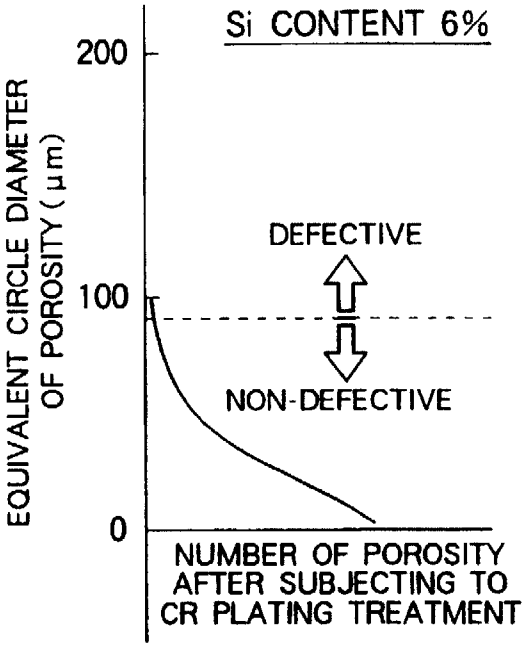

FIGS. 9A to 9C are graphs illustrating a porosity distribution of the aluminum alloy decorative cover of the present invention, and the coordinate indicates a diameter of an equivalent circle of the porosity. As explained in the "BACKGROUND OF THE INVENTION", the term "equivalent circle diameter of the porosity" of the coordinate used herein means a diameter of an equivalent circle of the porosity which is determined by the image-analysis of the shape of the porosity detected by an infiltration detecting process after buffing the aluminum alloy decorative cover. In addition, the broken line is a visual borderline indicating a limitation wherein the porosity can be visually confirmed. When the equivalent circle diameter of the porosity exceeds the visual borderline, it is judged to be defective. On the other hand, when the equivalent circle diameter of the porosity is below the visual borderline, it is judged to be non-defective. This visual borderline locates slightly below the equivalent circle diameter of 100 μm of the porosity. In addition, the region Z provided with a hatching is a part where the porosity can be visually observed.

Figure 19A:
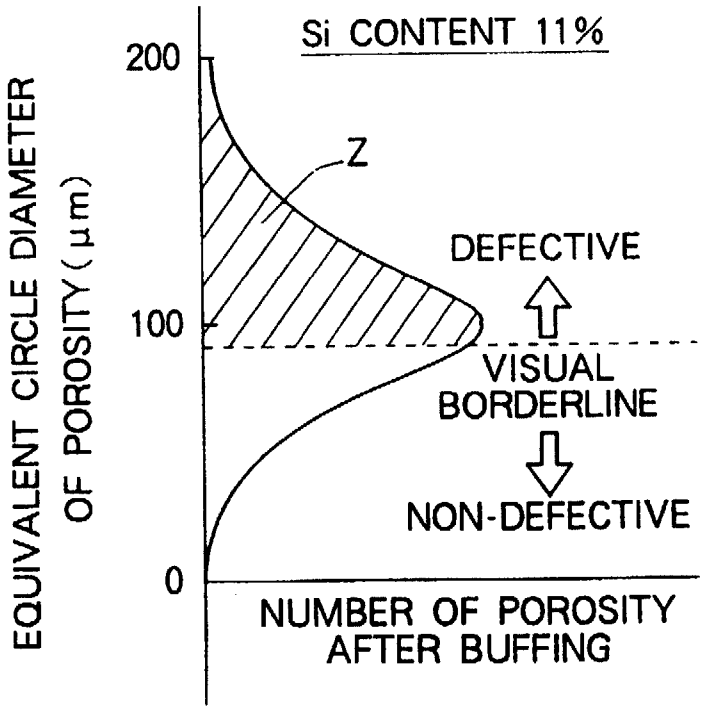
FIG.19A (PRIOR ART)
FIGS. 19A and 19B are graphs illustrating a porosity distribution of a conventional aluminum alloy decorative cover.
Figure 19B:
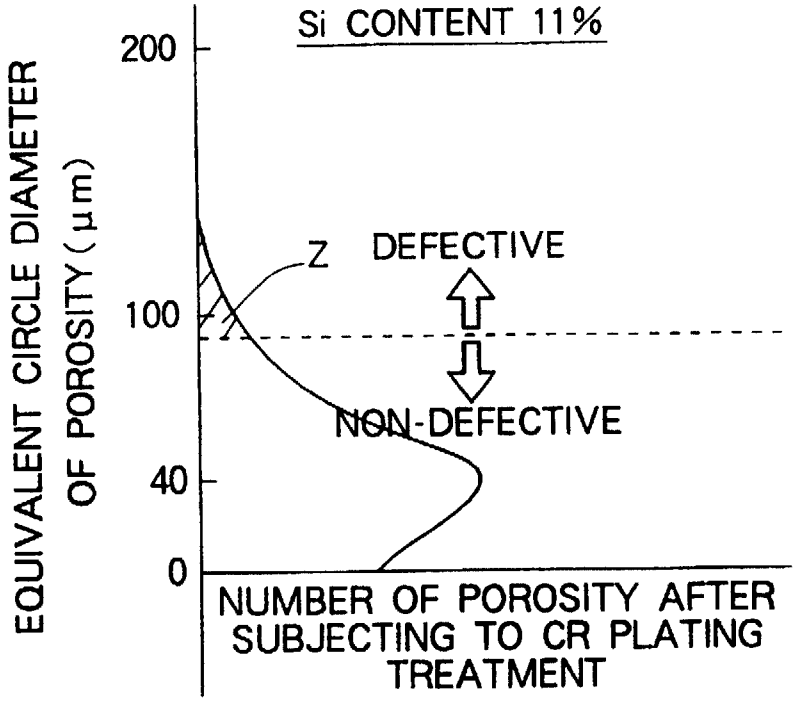
FIG.19B (PRIOR ART)
Figure 20:
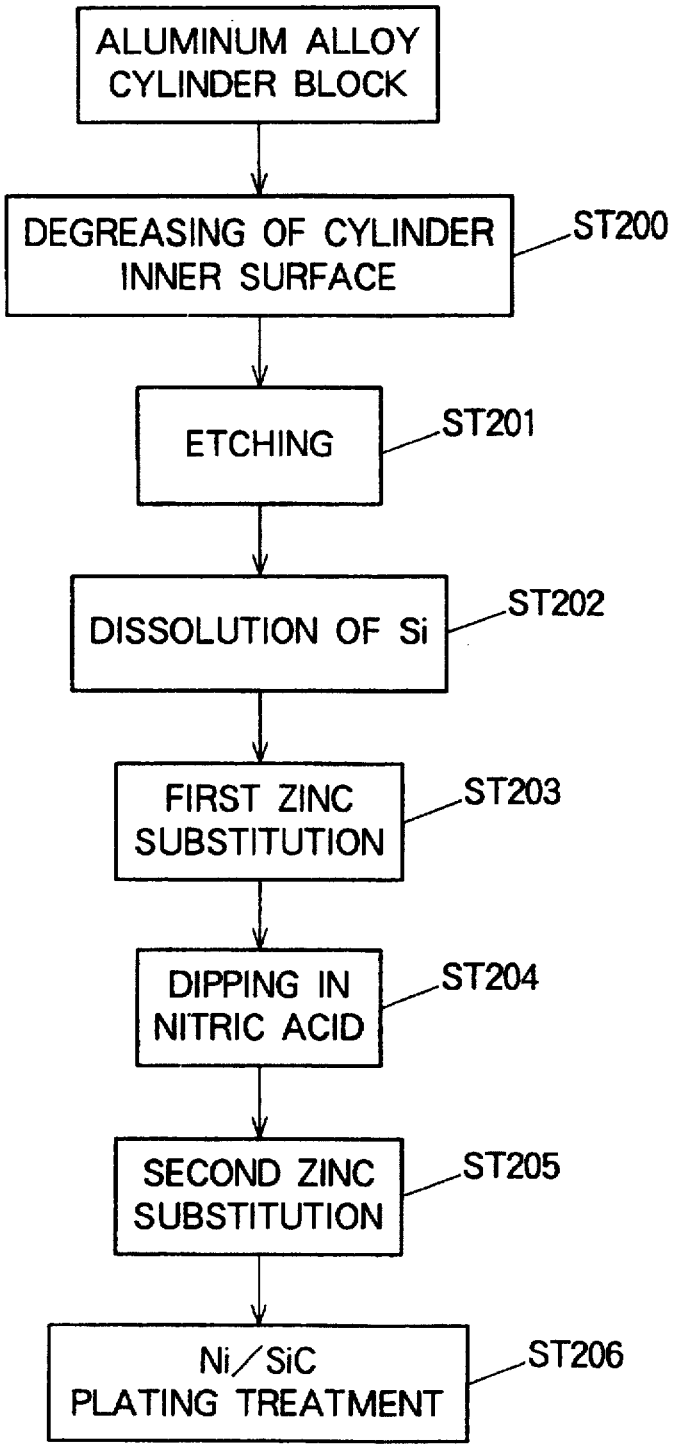
FIG.20 (PRIOR ART)
FIG. 20 is a flow chart illustrating steps of the surface treatment of a conventional inner circumferential surface of cylinder.

FIG. 9A illustrates a porosity distribution (after buffing) of a crankcase cover 10 molded by using a cast aluminum alloy (Si content: 11%) according to the same condition as that of FIG. 19A as the prior art, and the abscissa indicates the number of the porosity after buffing. As is apparent from the graph of FIG. 9A, the porosity distribution of the decorative cover after buffing shows a peak at about 100 μm. The majority of the porosities are in the defective state.

FIG. 9B illustrates a porosity distribution of a crankcase cover 10 (Si content: 8%) after subjecting to Cr plating, and the abscissa indicates the number of the porosity of the surface of the decorative cover after subjecting to the Cr plating treatment. That is, the crankcase cover molded by using the material ADC12-JIS was subjected to an anodizing treatment for 30 minutes or less, and the Si content was 8%. As is apparent from the graph of FIG. 9B, when the Si content is 8%, the porosity distribution of the decorative cover after subjecting to the Cr plating treatment shows a peak at about 30 μm. Therefore, the amount of the porosity in non-defective state increases but the porosity in the defective state also exists.

FIG. 9C illustrates a porosity distribution of a crankcase cover 10 (Si content: 6%) after subjecting to Cr plating, and the abscissa indicates the number of the porosity of the surface of the decorative cover after subjecting to the Cr plating treatment. That is, the crankcase cover molded by using the material ADC12-JIS was subjected to an anodizing treatment for 30 minutes, and the Si content was 6%. As is apparent from FIG. 9C, the porosity in the defective state does not exist on the surface of the decorative cover after subjecting to the Cr plating treatment.

Accordingly, when the material ADC12-JIS is subjected to the anodizing treatment for about 30 minutes to reduce the Si content to 6% as shown in Example 11 of Table 12, the porosity in the defective state does not exist on the surface of the decorative cover after subjecting to the Cr plating treatment.

Table 13 illustrates results of a comparison between the hole fill effect of Example 11 and that of Comparative Example 8. In order to make a comparison between the quality of Example 11 and that of Comparative Example 8, the porosity found by an infiltration detecting test was image-analyzed to determine an equivalent circle diameter of the porosity. In addition, a comparison between the state of the porosity of the surface of the decorative cover after buffing and that after subjecting to the Cr plating treatment of Example 11 and that of Comparative Example 8 was made. The results are shown in Table 13.

TABLE 13

| example 11 | | | comparative example 8 | | |
|---|---|---|---|---|---|
| equivalent circle diameter of porosity (μm) | | | equivalent circle diameter of porosity (μm) | | |
| before treatment | after treatment | fill effect (%) | before treatment | after treatment | fill effect (%) |
| 114.0 | 0 | 100 | 116.1 | 106.9 | 7.9 |
| 117.4 | 0 | 100 | 119.7 | 108.9 | 9.0 |
| 118.6 | 0 | 100 | 125.3 | 108.9 | 13.1 |
| 132.4 | 0 | 100 | 153.2 | 114.8 | 25.1 |
| 149.8 | 0 | 100 | 101.4 | 12.6 | 87.6 |
| average diameter: 126.4 μm | 0 | 100 | | — | |

As shown in Table 13, in case of Example 11, the porosity having the equivalent circle diameter of 114.0 μm of the surface of the decorative cover after buffing was completely filled after subjecting to the Cr plating treatment. Similarly, each porosity having the equivalent circle diameter of 117.4, 118.6, 132.4 or 149.8 μm of the surface of the decorative cover after buffing was completely filled after subjecting to the Cr plating treatment. That is, the porosity having an average diameter (126.4 μm) of the diameter of the equivalent circle of the above respective porosities can be completely filled.

On the other hand, in case of Comparative Example 8, the diameter of the porosity having the equivalent circle diameter of 116.1 μm which exists on the surface of the decorative cover after buffing became 106.9 μm after subjecting to the Cr plating treatment, and the hole fill effect was 7.9%. The diameter of the porosity having the equivalent circle diameter of 119.7 μm became 108.9 μm after subjecting to the Cr plating treatment, and the hole fill effect was 9.0%. The diameter of the porosity having the equivalent circle diameter of 125.3 μm became 108.9 μm after subjecting to the Cr plating treatment, and the hole fill effect was 13.1%. The diameter of the porosity having the equivalent circle diameter of 153.2 μm became 114.8 μm after subjecting to the Cr plating treatment, and the hole fill effect was 25.1%. In addition, the diameter of the porosity having the equivalent circle diameter of 101.4 μm became 12.6 μm after subjecting to the Cr plating treatment, and the hole fill effect was 87.6%.

Thus, according to the treating process of the present invention, the porosity can be completely filled by subjecting to the anodizing treatment for about 30 minutes to reduce the Si content to 6%. However, it has been found that the porosity can not be filled even when subjecting to plating according to a conventional treating process.

As described above, according to the present invention, the decorative cover for motorbike is made of an aluminum material containing Si and the surface of the aluminum material is buffed, and then an anodized film is formed on the buffed surface by using an electrolyte including the compound (1) containing an anion having complexing capability, organic acid (2) containing an oxyacid anion and halide (3). Thereby, the porosity exposed on the surface of the decorative cover can be changed in to a microhole by forming the anodized film, or filled.

In addition, the halide (3) selectively dissolves inclusions (e.g. Si, etc.), additive metals and intermetallic compounds, together with the oxyacid anion (2), to remove them from the anodized film. Therefore, the corrosion resistance is extremely improved.

Furthermore, the compound (1) containing an anion having complexing capability has an action of smoothing the anodized film. That is, when the anodized film has a concave-convex part on the outer surface in the process of forming, the compound containing an anion adheres thickly to the concave part, and adheres thinly to the convex part. The eluation rate of an Al ion is slow at the concave part and fast at the convex part, seemingly. Therefore, the porosity which exists on the surface of the decorative cover is filled up, thereby smoothing the surface of the decorative cover. In addition, the micropore remaining on the anodized film is filled by subjecting the anodized film to Ni plating and subjecting the surface of the Ni plating film to Cr plating. Therefore, the porosity exposed on the surface of the decorative cover can be sufficiently filled.

Next, a scroll member for a compressor to which the present invention was applied will be explained.

Figure 10:
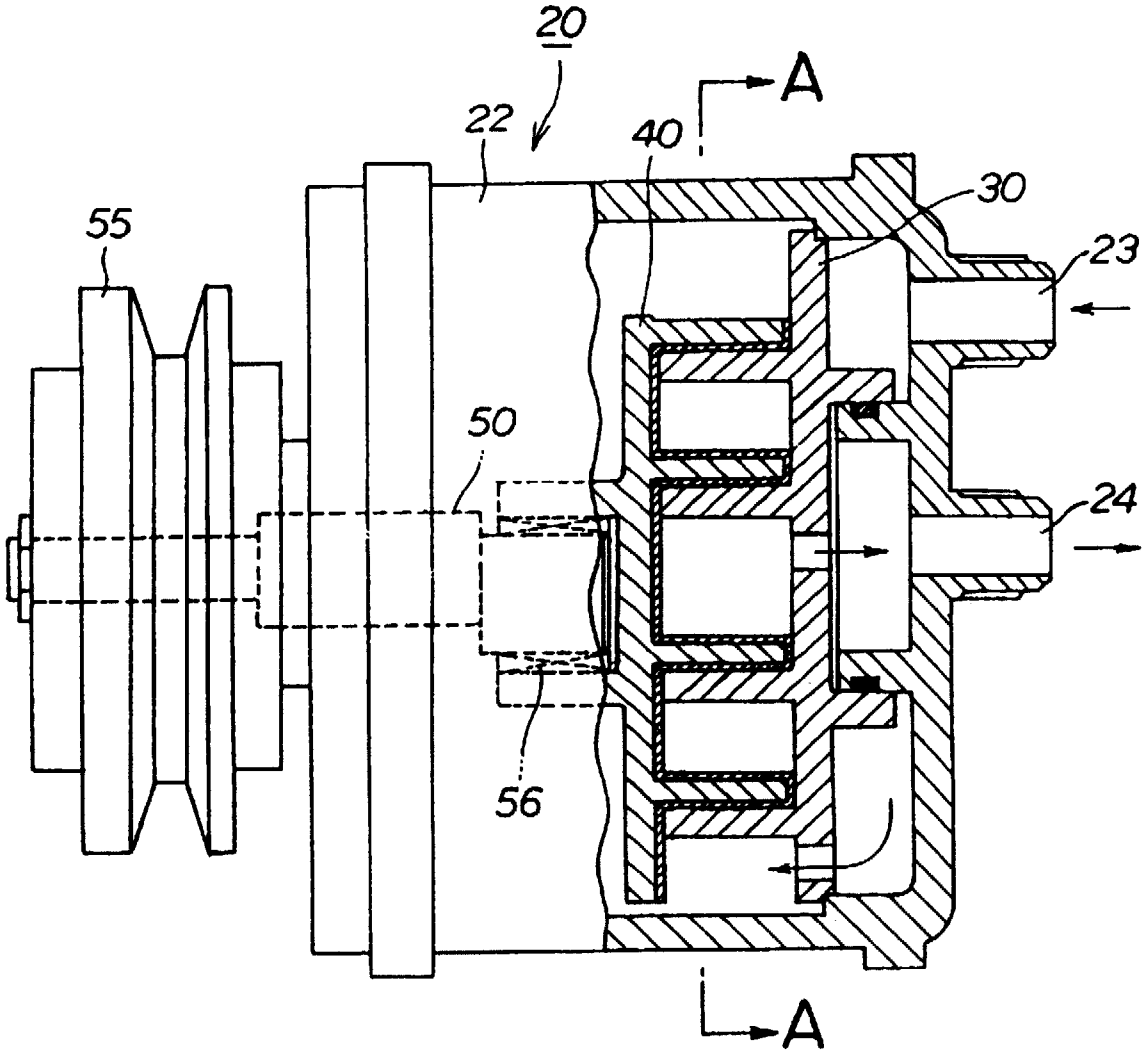
FIG. 10 is a partially schematic sectional view illustrating a compressor in to which the scroll member for the compressor of the present invention is incorporated.

FIG. 10 is a partially schematic sectional view illustrating a compressor into which the scroll member for a compressor of the present invention is incorporated, and a compressor 20 consists of a casing 22, a fixed scroll member 30 fixed in the casing 22, a movable scroll member 40 engaged slidably with the fixed scroll member 30 and an eccentric shaft 50 connected rotatably to the movable scroll member 40. The casing 22 is provided with a suction port 23 and an exhaust port 24. The suction port 23 and exhaust port 24 are formed at the end part of the casing 22. In addition, part 55 is a pulley provided at the left end part of the eccentric shaft 50, and 56 is a bearing.

Figure 11:
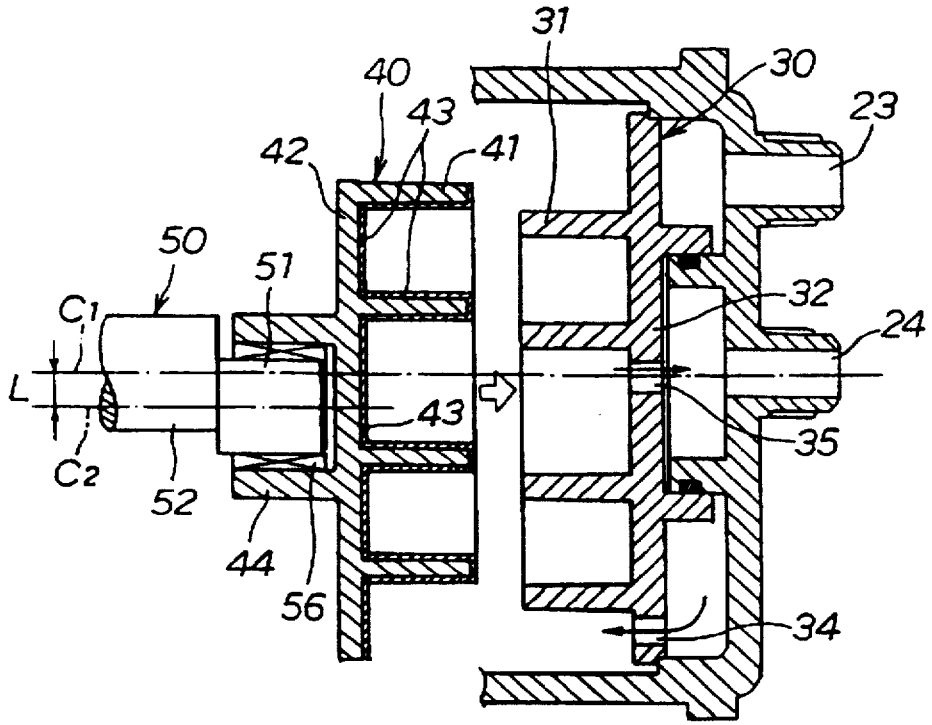
FIG. 11 is an exploded perspective view illustrating the scroll member for the compressor of the present invention.

FIG. 11 is an exploded perspective view illustrating the scroll member for the compressor of the present invention, and the fixed scroll member 30 consists of a spiral scroll part 31 and a disc part 32. The movable scroll member 40 consists of a spiral scroll part 41 and a disc part 42, and an anodized film 43 described hereinafter was formed on the surface of the spiral scroll part 41 and that of the disc part 42, respectively.

Thereby, an oxide film has been formed on the sliding surface between the fixed scroll member 30 and movable scroll member 40.

In addition, the movable scroll member 40 forms a bearing part 44 at the side of the eccentric shaft 50 of the disc part 42 to support rotatably an eccentric part 51 of the eccentric shaft 50 on the bearing part 44 through a bearing 56. The eccentric part 51 is that whose center $C_1$ is offset from the center $C_2$ from a main shaft part 52 of the eccentric shaft 50 by L. In addition, the center $C_2$ of the main shaft part 52 is supported on the same shaft as that of the fixed scroll member 30, and the center $C_1$ of the eccentric part 51 is supported on the same shaft as that of the movable scroll member 40. Further, the disc part 32 of the fixed scroll member 30 is provided with a suction port 34 and an exhaust port 35.

Figure 12:
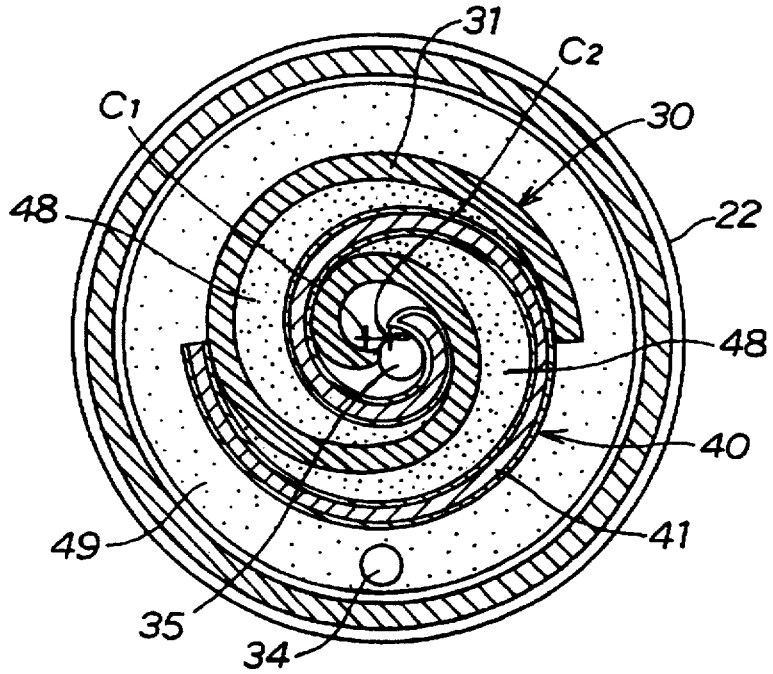
FIG. 12 is a schematic sectional view taken in the line A—A of FIG. 10.

FIG. 12 is a schematic sectional view taken in the line A—A of FIG. 10, and illustrates the state where the fixed scroll member 30 is engaged slidably with the movable scroll member 40. In this case, a scroll part 31 is engaged with a scroll part 41 to form closed spaces 48, 48. In addition, the casing 22 and the outer surface of the fixed and movable scroll members 30, 40 form an suction space 49, and form the suction port 34 for sucking air in to the suction space 49 on the disc part 32 as shown in FIG. 11.

Next, the action of the above-described scroll member for the compressor will be explained.

Firstly, a pulley 55 shown in FIG. 10 is rotated to rotate the eccentric shaft 50 around the main shaft part 52 as shown in FIG. 11, thereby rotating the eccentric part 51 and movable scroll member 40 around the center $C_1$ of the main shaft part 52 as an axis.

Figure 13A:
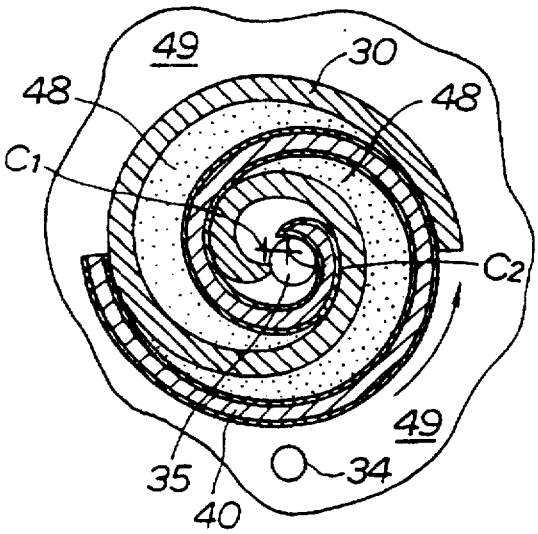
FIGS. 13A to 13D are schematic diagrams for explaining an operation of the scroll member for the compressor of the present invention.

FIGS. 13A to 13D are schematic diagrams for explaining an operation of the scroll member for the compressor of the present invention. In FIG. 13A to 13D, the movable scroll member 40 revolves around the center $C_1$ as an axis. FIG. 13A illustrates the state where air introduced from the suction space 49 is sealed in the closed spaces 48, 48.

Figure 13B:
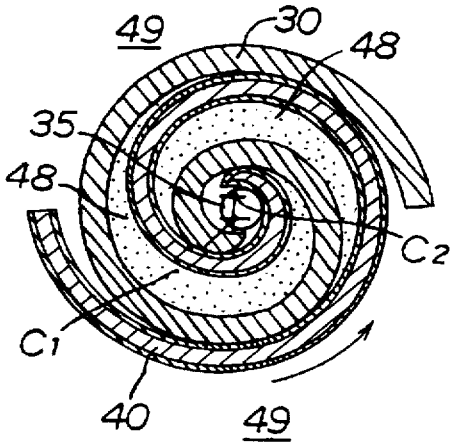

FIG. 13B illustrates the state where the center $C_2$ of the movable scroll member 40 revolved counterclockwise around the center $C_1$ as an axis by 90° from FIG. 13A. Thereby, the center $C_2$ of the movable scroll member 40 moved to the location above the center $C_1$ to reduce a volume of the closed spaces 48, 48, thereby compressing air in the closed spaces 48, 48.

Figure 13C:
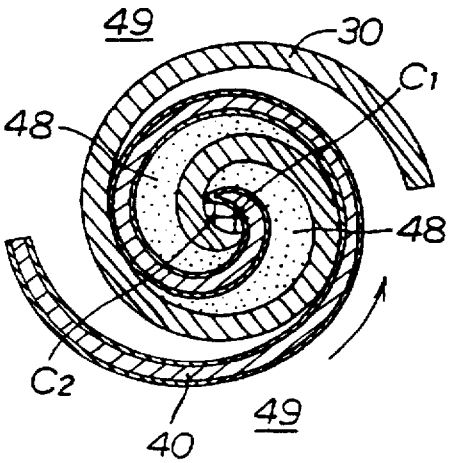

FIG. 13C illustrates the state where the center $C_2$ of the movable scroll member 40 revolved counterclockwise around the center $C_1$ as an axis by 90° from FIG. 13B. Thereby, the center $C_2$ of the movable scroll member 40 moved to the location on the left side of the center $C_1$ to reduce a volume of the closed spaces 48, 48 thereby compressing air in the closed spaces 48, 48 stronger than that of the state of FIG. 13B.

Figure 13D:
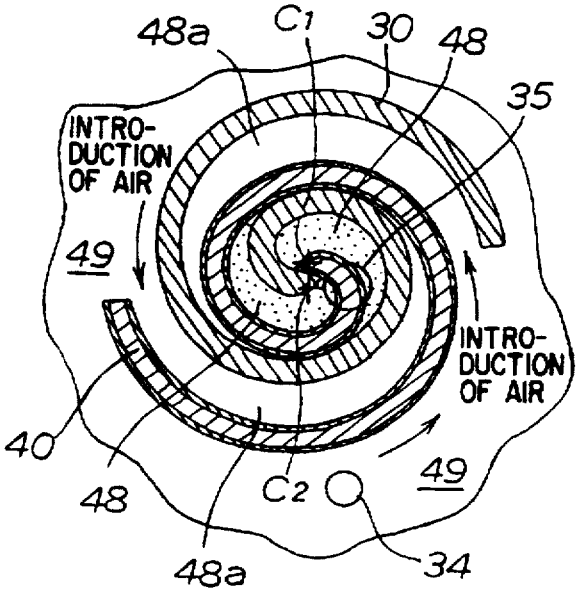

FIG. 13D illustrates the state where the center $C_2$ of the movable scroll member 40 revolved counterclockwise around the center $C_1$ as an axis by 90° from FIG. 13C. Thereby, the center $C_2$ of the movable scroll member 40 moved to the location below the center $C_1$ to reduce a volume of the closed spaces 48, 48, thereby compressing air in the closed spaces 48, 48 to a predetermined pressure. In addition, air compressed to the predetermined pressure is exhausted from the exhaust port 35.

On the other hand, air is sucked through the suction port 34 in to the suction space 49 to introduce air in to the spaces 48*a*, 48*a* formed separately. Then, by changing from the state of FIG. 13D to that of FIG. 13A, the spaces 48*a*, 48*a* becomes the closed spaces 48, 48. Furthermore, by repeating the step of FIG. 13A to FIG. 13D in order, compressed air is exhausted from the exhaust port 4 shown in FIG. 10.

Next, a method for forming the above-mentioned anodized film 43 on a scroll member for compressor will be explained.

The following Example 12 and Comparative Example 9 will be explained according to the above-described condition of the pretreatment shown in Table 1. That is, a treatment of removing grease from the surface of the matrix (aluminum material) is conducted in the prestep of the anodizing step.

Example 12 and Comparative Example 9

The matrix of Example 12 and Comparative Example 9 is AC8C-JIS H5202 as a die cast aluminum alloy containing 2.0 to 4.0 wt % Cu, 8.5 to 10.5 wt % Si and not more than 1.0 wt % Fe, a main component of which is as shown in

TABLE 14

(wt %)

| | Cu | Si | Fe | Mg.Zn.Mn.Ni Ti.Pb.Sn.Cr | Al |
|---|---|---|---|---|---|
| AC8C-JISH5202 | 2.0~4.0 | 8.5~10.5 | 1.0 or less | trace or 0 | balance |

In Example 12, the material AC8C-JIS H5202 subjected to the above pretreatment was subjected to an anodizing treatment using an electrolyte including tribasic sodium phosphate (0.5 wt % ), sorbitol (0.9 wt %) and potassium fluoride (0.3 wt %) as shown in Table 15 to form a film of 5 μm. The solution temperature was 10° C. and voltage was 50 V (DC). In addition, the operation time was 30 minutes.

TABLE 15

| matrix | example 12 AC8C - JISH5202 | comparative example 9 AC8C - JISH5202 |
|---|---|---|
| component of electrolyte | tribasic sodium phosphate: 0.5 wt % sorbitol: 0.9 wt % potassium fluoride 0.3 wt % | anodizing film treatment using 15 wt % sulfuric acid |
| soilution temperature | 10° C. | 3° C. |
| voltage | 50 V | 32 V |
| operation time | 30 min | 25 min |
| thickness of anodized film | 5 μm | 20 μm |
| seizing load | 0.45 kgf/mm$^2$ | 0.18 kgf/mm$^2$ |
| lubricant | Honda Ultra U (trade mark) | Honda Ultra U (trade mark) |
| sliding rate | 10 m/s | 10 m/s |

In Comparative Example 9, the material AC8C-JIS subjected to the above pretreatment was subjected to an anodizing treatment using 15 wt % sulfuric acid as shown in Table 15 to form a film of 20 μm. The solution temperature was 3° C. and voltage was 32 V (DC). In addition, the operation time was 25 minutes.

In order to make a comparison between seizing characteristics of Example 12 and those of Comparative Example 9, a frictional wear test was conducted using test pieces of Example 12 and Comparative Example 9. Further, Honda Ultra U (trade name) was used as the lubricant, and the sliding rate was 10 m/second.

As a result, the film formed in Example 12 caused no seizing at the load of 0.45 Kgf/mm$^2$ or less, but the film formed in Comparative Example 9 caused a seizing at the load of 0.18 Kgf/mm$^2$.

Figure 14:
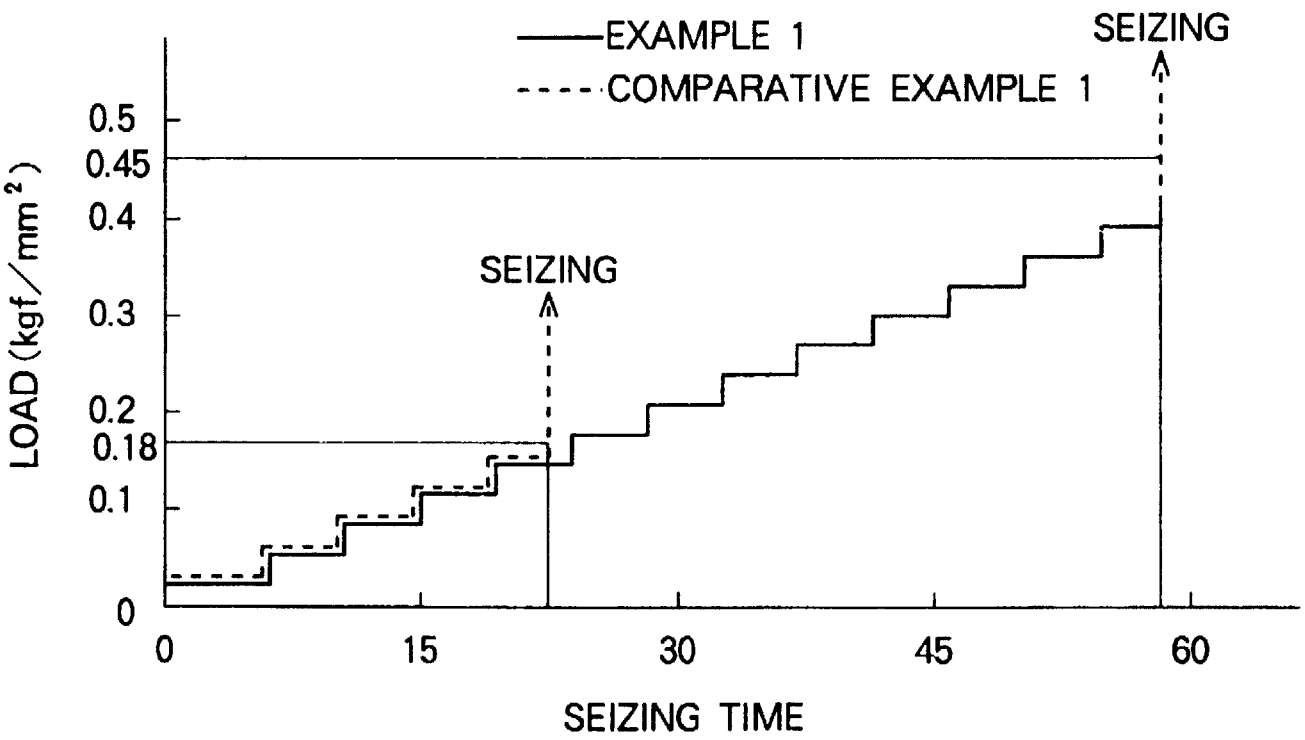
FIG. 14 is a graph illustrating seizing characteristics of the scroll member for the compressor of the present invention.

FIG. 14 is a graph illustrating seizing characteristics of the scroll members for compressor of Example 12 and Comparative Example 9 of the present invention. The coordinate indicates a load, and the abscissa indicates a seizing time. The lubricant and sliding rate are as shown in Table 15. As a result, as described above, the film formed in Example 12 caused no seizing at the load of 0.45 Kgf/mm$^2$ or less but the film formed in Comparative Example 9 caused a seizing at the load of 0.18 Kgf/mm$^2$.

A relationship between the Si content in the anodized film and formation rate of pit is shown in Table 16.

TABLE 16

| scroll member | si content in film (%) | evaluation |
|---|---|---|
| ADC14 | comparative example 10 | X |
| | example 13 10 | X |
| | 8 | ○ |
| | 6 | ⊙ |
| ADC12 | comparative example 11 | X |
| | example 14 10 | X |
| | 8 | ○ |
| | 6 | ⊙ |
| AC8C | comparative example 12 | X |
| | example 15 8 | ○ |
| | 6 | ⊙ |
| AC4C | comparative example 13 | ○ |
| | example 16 | ⊙ |

X: formation rate of pit is not less than 5%
○: formation rate of pit is 3 to 5%
⊙: formation rate of pit is not more than 3%

In Comparative Example 10 of Table 16, the material ADC14-JIS was subjected to the anodizing treatment by a conventional process according to the same manner as that described in Comparative Example 9. Accordingly, the Si content in the anodized film was not decreased and, therefore, the formation rate of pit was not less than 5%. On the other hand, in case of Example 13, the material ADC14-JIS was subjected to the anodizing treatment according to the same manner as that described in Example 11 to decrease the Si content in three patterns, e.g. 10%, 8% and 6%, thereby determining the formation rate of pit due to each pattern. As a result, when the Si content was 10%, the formation rate of pit is not less than 5%. When the Si content was 8%, the formation rate of pit was 3 to 5%. When the Si content was 6%, the formation rate of pit was not more than 3%.

In Comparative Example 11 of Table 16, the material ADC12-JIS was subjected to the anodizing treatment by a conventional process according to the same manner as that described in Comparative Example 9. Accordingly, the Si content in the anodized film was not decreased and, therefore, the formation rate of pit was not less than 5%. On the other hand, in case of Example 14, the material ADC12-JIS was subjected to the anodizing treatment according to the same manner as that described in Example 11 to decrease the Si content in three patterns, e.g. 10%, 8% and 6%, thereby determining the formation rate of pit due to each pattern. As a result, when the Si content was 10%, the formation rate of pit was not less than 5%. When the Si content was 8%, the formation rate of pit was 3 to 5%. When the Si content was 6%, the formation rate of pit was not more than 3%.

In Comparative Example 12 of Table 16, the material AC8C-JIS was subjected to the anodizing treatment by a conventional process according to the same manner as that described in Comparative Example 9. Accordingly, the Si content in the anodized film was not decreased and, therefore, the formation rate of pit was not less than 5%.

On the other hand, in case of Example 15, the material AC8C-JIS was subjected to the anodizing treatment according to the same manner as that described in Example 11 to decrease the Si content in two patterns, e.g. 8% and 6%, thereby determining the formation rate of pit due to each pattern. As a result, when the Si content is 8%, the formation rate of pit was 3 to 5%. When the Si content was 6%, the formation rate of pit was not more than 3%.

In Comparative Example 13 of Table 16, the material AC4C-JIS was subjected to the anodizing treatment by a conventional process according to the same manner as that described in Comparative Example 9. In this case, the formation rate of pit was 3 to 5%.

On the other hand, in case of Example 16, the material AC4C-JIS was subjected to the anodizing treatment according to the same manner as that described in Example 11 to decrease the Si content to 6%, thereby determining the formation rate of pit. As a result, when the Si content was 6%, the formation rate of pit was not more than 3%.

As described above, it has been found from Table 16 that the formation rate of pit of the anodized film is decreased when the Si content in the anodized film is decreased. Particularly, when the Si content in the anodized film is not more than 8%, the formation rate of pit can be decreased to form a smooth anodized film.

In Examples 11 to 16, the case that the anodized film was formed on the movable scroll member 40 was explained. In addition, this anodized film may be subjected to the treatment due to one sort selected from electroplating, dip plating and electrolytic coloring or a combination thereof. Since this treatment is a sealing treatment, the micropore remained on the anodized film can be filled.

In this case, the anodized films of Examples 11 to 16 contain a little Si, and the amount of Si becomes so small that an electrolysis of water using Si as an electrode can be ignored. Therefore, a wasteful consumption of the current in the electroplating can be inhibited.

In Examples 11 to 16, the case that the anodized film 43 was formed on the movable scroll member 40 was explained, but the same effect can be obtained even if the anodized film is formed on the fixed scroll member 30 in place of the movable scroll member 40.

As described above, according to the present invention, the scroll member is made of an aluminum material containing Si, and then an anodized film is formed on the surface of the scroll member by using an electrolyte of the compound (1) containing an anion having complexing capability, organic acid (2) containing an oxyacid anion, and halide (3). The halide (3) selectively dissolves inclusions (e.g. Si, etc.), additive metals and intermetallic compounds, together with the oxyacid anion (2), to remove them from the anodized film. Therefore, the seizing properties of the anodized film are extremely improved. Furthermore, the strength of the surface of a pair of scroll members is increased by coating the surface of a pair of scroll members with an anodized film.

In addition, the compound (1) containing an anion having complexing capability has an action of smoothing the anodized film. That is, when the anodized film has a concave-convex part on the outer surface in the process of forming, the compound containing an anion adheres thickly to the concave part, and adheres thinly to the convex part. The eluation rate of an Al ion is slow at the concave part and fast at the convex part, seemingly. Therefore, the outer surface of the anodized film is smoothed.

Figure 15:
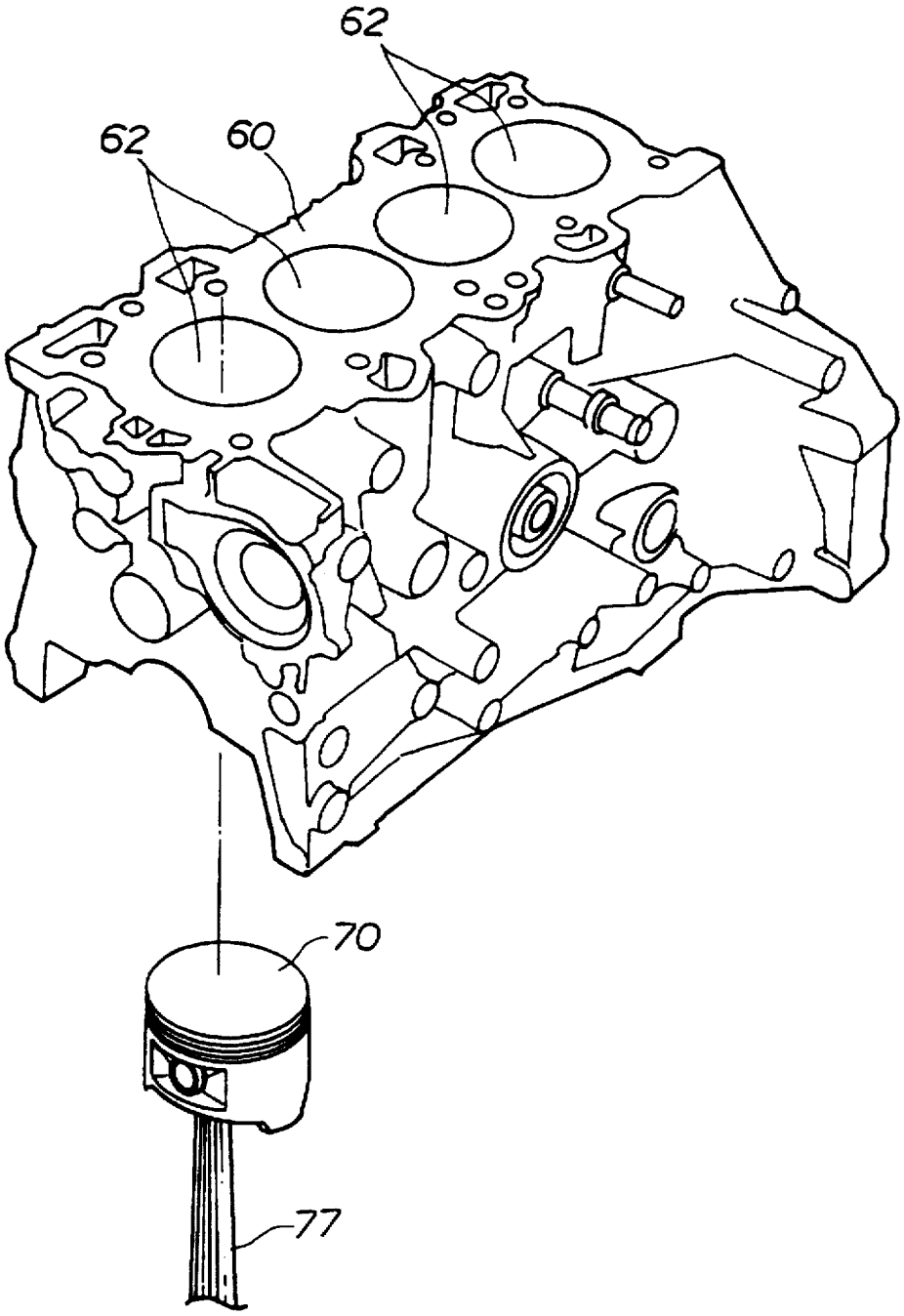
FIG. 15 is a perspective view illustrating the cylinder block for an internal combustion engine of the present invention.

FIG. 15 is a perspective view illustrating the cylinder block for an internal combustion engine of the present invention. A cylinder block for an internal combustion engine 60 is a so-called linerless cylinder block made of an aluminum alloy, and an inner circumferential surface of cylinder 62 is integrally molded with the cylinder block for the internal combustion engine 60. A piston 70 is fit slidably in to the inner circumferential surface of cylinder 62. Further, a part 77 is a connecting rod.

Figure 16:
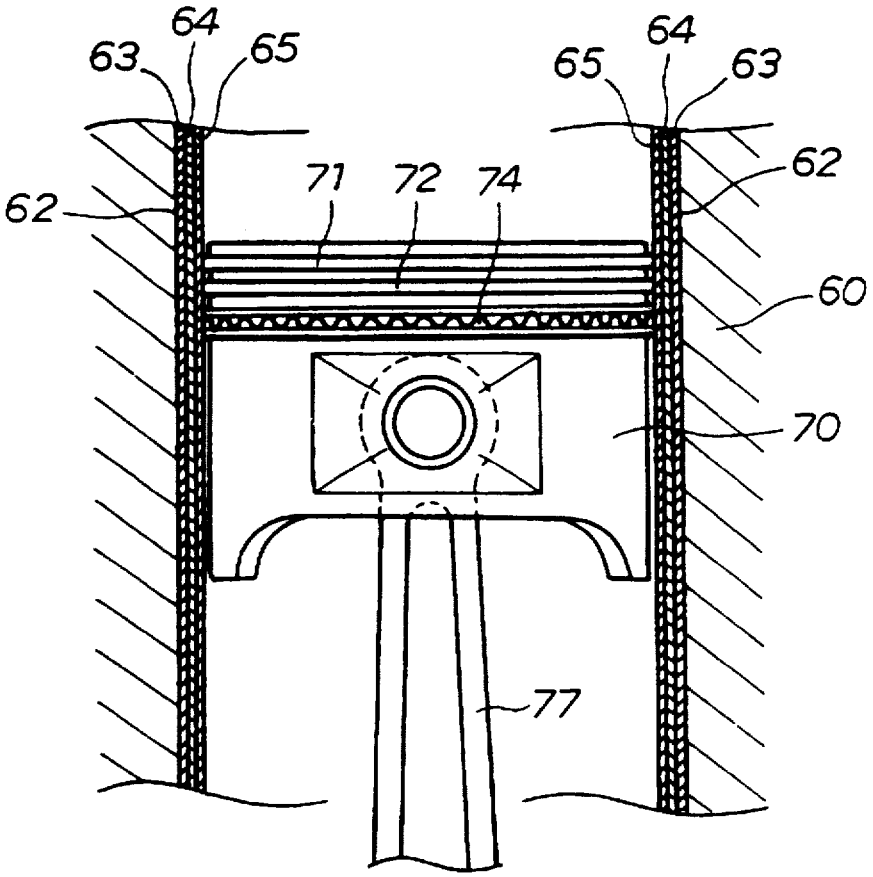
FIG. 16 is a sectional view illustrating the cylinder block for an internal combustion engine of the present invention.

FIG. 16 is a sectional view illustrating the cylinder block for an internal combustion engine of the present invention.

and an anodized film 63 was formed on the inner circumferential surface of cylinder 62 and a Ni/SiC plating film 65 was formed on the surface of the anodized film 63. Further, 71 is a top ring for compression and 72 is a second ring for compression, and 74 is an oil ring.

A process for laminating the above anodized film 63 and Ni/SiC plating film 65 on the inner circumferential surface of cylinder 62 of this cylinder block for an internal combustion engine will be explained below.

Figure 17:
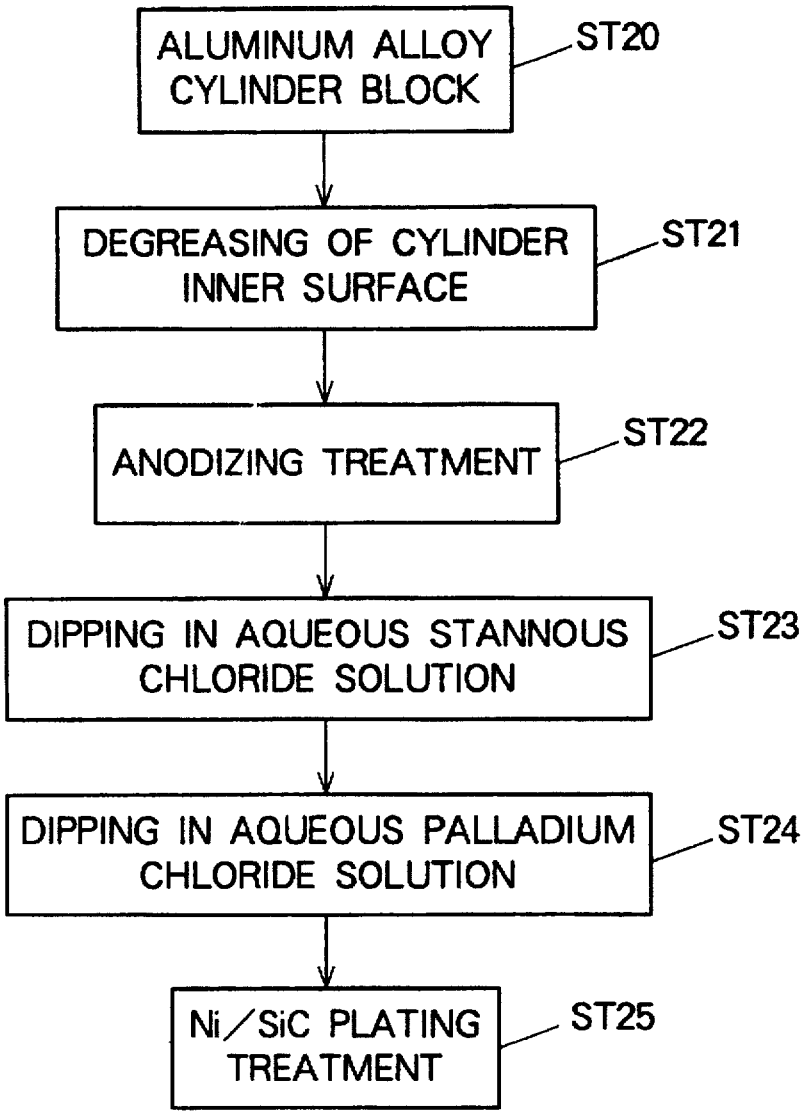
FIG. 17 is a flow chart illustrating steps of the surface treatment of the inner circumferential surface of cylinder of the cylinder block for an internal combustion engine of the present invention.

FIG. 17 is a flow chart illustrating steps of the surface treatment of the inner circumferential surface of cylinder 62 of the cylinder block for an internal combustion engine of the present invention. The cylinder block for an internal combustion engine 60 made of an aluminum alloy is subjected to die casting in the step (hereinafter abbreviated to "ST") 20. After grease is removed from the surface of the cylinder inner surface 62 in ST21, an anodized film is formed on the cylinder inner surface 62 in ST22. After the surface of the anodized film is dipped in an aqueous stannous chloride solution and an aqueous palladium chloride solution in order in ST23 and ST24, the surface is subjected to Ni/SiC composite plating in ST25.

The above-described Table 1 shows a decreasing condition of Example 17 and Comparative Example 14 described hereinafter. That is, as described in ST21 of FIG. 17, grease is removed from the surface of the matrix (aluminum material) in the prestep of the anodizing step.

Example 17 and Comparative Example 14

The matrix of Example 17 and Comparative Example 14 is ADC12-JIS H5302 as a die cast aluminum alloy containing 1.5 to 3.5 wt % Cu, 9.6 to 12.0 wt % Si and 0.3 to 0.6 wt % Fe, a main component of which is as shown in Table 2.

In Example 17, the material ADC12-JIS H5302 subjected to the above pretreatment was subjected to an anodizing treatment using an electrolyte including tribasic sodium phosphate (0.3 mol), sodium tartrate (0.5 mol) and potassium fluoride (0.5 mol) as shown in Table 17 to form a film of 5 μm as shown in ST22 of FIG. 17. The solution temperature was 20° C. and voltage was 50 V (DC). In addition, the operation time was 30 minutes.

TABLE 17

| matrix | example 17<br>ADC12 - JI8H5302 | comparative example 14<br>ADC12 - JISH5302 |
|---|---|---|
| component of electrolyte | tribasic sodium phosphate: 0.3 mol<br>sodium tartrate: 0.5 mol<br>potassium fluoride: 0.5 mol | etching: sodium hydroxide (5 to 10 g/l)<br>temperature: 50° C.<br>treating time: 30 seconds |
| solution temperature (voltage) | 20° C. (50 V) | dissolution of Si: |
| operation time | 30 min | nitric acid (50 wt %) + hydrogen |
| thickness of anodized film | 5 μm | fluoride (20 ml/l)<br>temperature: 23° C.<br>treating time: 30 seconds |
| dipping | aqueous stannous chloride solution (normal temperature, 4%), 60 second dipping<br>aqueous palladium chloride solution (normal temperature, 0.05%), 60 second dipping | — |
| Ni/Sic composite plating | voltage: 3 V, operation time: 20 minutes | voltage: 3 V, operation time: 20 minutes |
| durability test | temperature: 250° C., time: 1 hour | temperature: 250° C., time: 1 hour |
| test results (% failure) | 2.5% | 6% |

The surface of the resulting anodized film is washed by dipping in an aqueous 4% stannous chloride solution at normal temperature for 60 seconds as shown in ST23 of FIG. 17, and then washed by dipping in an aqueous 0.05% palladium chloride solution at normal temperature for 60 seconds as shown in ST24. Then, the dipped surface is subjected to Ni/SiC composite plating as shown in ST25. The condition of the Ni/SiC composite plating is as shown in Table 17. The resultant was treated in a predetermined plating solution while applying an AC voltage of 3 V (50 Hz) for 20 minutes to form a Ni/SiC composite plating film on the anodized film.

In Comparative Example 14, the material ADC12-JIS subjected to the above pretreatment (decreasing treatment) was subjected to etching using a sodium hydroxide solution (5 to 10 g/l) at 50° C. for 30 seconds as shown in Table 17, and then subjected to a Si dissolution treatment using a mixed solution of nitric acid (50 wt %) and hydrogen fluoride (20 ml/l) for 30 seconds. In this case, the temperature of the mixed solution is 23° C. Then, a Zn substrate was formed on the inner circumferential surface of cylinder by subjecting to a first zinc substitution treatment. After harmful Si was removed by subjecting to a nitrogen dipping treatment, a Zn substrate is formed by subjecting to a second zinc substitution treatment. Then, it was subjected to a Ni/SiC composite plating according to the same manner as that described in Example 17.

In order to make a comparison between the quality of Example 17 and that of Comparative Example 14, the durability test of Example 17 and Comparative Example 14 was conducted. This durability test was conducted at the ambient temperature of 250° C. for one hour. As a result, defectives in Comparative Example 14 was as large as 6%, while defectives in Example 17 was only 2.5% and was drastically decreased in comparison with Comparative Example 14.

A relationship between the formation rate of pit of Examples and that of Comparative Examples is shown in Table 18. In the Examples, a relationship between the Si content in the anodized film and formation rate of pit is shown.

TABLE 18

| material of inner surface | object to be evaluated | | evaluation |
|---|---|---|---|
| ADC14 | comparative example 15 | | X |
| | example 18 | Si content 10(%) | X |
| | | 8(%) | ○ |
| | | 6(%) | ◎ |
| ADC14 | comparative example 16 | | X |
| | example 19 | Si content 10(%) | X |
| | | 8(%) | ○ |
| | | 6(%) | ◎ |
| ADC14 | comparative example 17 | | X |
| | example 20 | Si content 8(%) | ○ |
| | | 6(%) | ◎ |
| ADC14 | comparative example 15 | | ○ |
| | example 21 | | ◎ |

X: formation rate of pit is not less than 5%
○: formation rate of pit is 3 to 5%
◎: formation rate of pit is not more than 3%

In Comparative Example 15, of Table 18, the material ADC14-JIS was subjected to the anodizing treatment by a conventional process according to the same manner as that described in Comparative Example 14. Accordingly, the Si content in the anodized film was not decreased and, therefore, the formation rate of pit was not less than 5%.

On the other hand, in case of Example 18 , the material ADC14-JIS was subjected to the anodizing treatment according to the same manner as that described in Example 17 to decrease the Si content in three patterns, e.g. 10%, 8% and 6%, thereby determining the formation rate of pit due to each pattern. As a result, when the Si content was 10%, the formation rate of pit is not less than 5%. When the Si content was 8%, the formation rate of pit was 3 to 5%. When the Si content was 6%, the formation rate of pit was not more than 3%.

In Comparative Example 16 of Table 18, the material ADC12-JIS was subjected to the anodizing treatment by a conventional process according to the same manner as that described in Comparative Example 14. In this case, the formation rate of pit was not less than 5%.

On the other hand, in case of Example 19 , the material ADC12-JIS was subjected to the anodizing treatment according to the same manner as that described in Example 17 to decrease the Si content in three patterns, e.g. 10%, 8% and 6%, thereby determining the formation rate of pit due to each pattern. As a result, when the Si content was 10%, the formation rate of pit was not less than 5%. When the Si content was 8%, the formation rate of pit was 3 to 5%. When the Si content was 6%, the formation rate of pit was not more than 3%.

In Comparative Example 17 of Table 18, the material AC8C-JIS was subjected to the anodizing treatment by a conventional process according to the same manner as that described in Comparative Example 14. In this case, the formation rate of pit was not less than 5%.

On the other hand, in case of Example 20, the material AC8C-JIS was subjected to the anodizing treatment according to the same manner as that described in Example 17 to decrease the Si content in two patterns, e.g. 8% and 6%, thereby determining the formation rate of pit due to each pattern. As a result, when the Si content is 8%, the formation rate of pit was 3 to 5%. When the Si content was 6%, the formation rate of pit was not more than 3%.

In Comparative Example 18 of Table 18, the material AC4C-JIS was subjected to the anodizing treatment by a conventional process according to the same manner as that described in Comparative Example 14. In this case, the formation rate of pit was 3 to 5%.

On the other hand, in case of Example 21, the material AC4C-JIS was subjected to the anodizing treatment according to the same manner as that described in Example 17 to decrease the Si content to 6%, thereby determining the formation rate of pit. As a result, when the Si content was 6%, the formation rate of pit was not more than 3%.

As described above, it has been found from Table 18 that the formation rate of pit of the anodized film is decreased when the Si content in the anodized film is decreased to not more than 8%. Thereby, the smooth anodized film can be formed and, therefore, the cylinder inner surface is smoothed.

As described above, according to the present invention, the cylinder block is made of an aluminum material containing Si, and then an anodized film is formed on the inner circumferential surface of cylinder by using an electrolyte including the compound (1) containing an anion having complexing capability, organic acid (2) containing an oxyacid anion, and halide (3). Thereby, the number of steps of the surface treatment of the cylinder inner surface can be reduced. In addition, the halide (3) selectively dissolves inclusions (e.g. Si, etc.), additive metals and intermetallic compounds, together with the oxyacid anion (2), to remove them from the anodized film. Therefore, the adhesive properties of the Ni/SiC plating film are improved and seizing properties of the anodized film are improved, thereby improving the seizing properties of the cylinder inner surface.

Furthermore, the compound (1) containing an anion having complexing capability has an action of smoothing the anodized film. That is, when the anodized film has a concave-convex part on the outer surface in the process of forming, the compound containing an anion adheres thickly to the concave part, and adheres thinly to the convex part. The eluation rate of an Al ion is slow at the concave part and fast at the convex part, seemingly, which results in excellent hole fill characteristics. Therefore, the inner circumferential surface of cylinder is smoothed.

What is claimed is:

1. A process for anodizing an aluminum alloy containing Si, which comprises subjecting the aluminum alloy containing Si to an anodizing treatment using an electrolyte comprising:

(i) at least one compound containing an anion capable of coordinating as a ligand on a metal ion to form a complex during said anodizing treatment selected from the group consisting of sodium hydrogenphosphate and tribasic sodium phosphate, (ii) at least one salt of an organic acid containing an oxyacid anion selected from the group consisting of sodium citrate and sodium tartrate, or sorbitol, and (iii) at least one halide selected from the group consisting of potassium fluoride and sodium fluoride.

2. A process for anodizing an aluminum alloy, according to claim 1, wherein the amount of sodium hydrogenphosphate, tribasic sodium phosphate, sodium citrate, sodium tartrate, sorbitol, potassium fluoride and sodium fluoride is 0.2 to 0.5 mol, 0.2 to 0.4 mol, 0.1 to 0.75 mol, 0.1 to 0.55 mol, 0.25 to 0.75 mol, 0.1 to 0.75 mol and 0.1 to 0.75 mol, respectively.

3. A process for surface treatment of an aluminum alloy containing Si, the process comprising:

a first step of subjecting the aluminum alloy containing Si to an anodizing treatment using an electrolyte comprising:

(i) at least one compound containing an anion capable of coordinating as a ligand on a metal ion to form a complex during said anodizing treatment selected from the group consisting of sodium hydrogenphosphate and tribasic sodium phosphate, (ii) at least one salt of an organic acid containing an oxyacid anion selected from the group consisting of sodium citrate and sodium tartrate, or sorbitol, and (iii) at least one halide selected from the group consisting of potassium fluoride and sodium fluoride; and a second step of subjecting the resulting oxide film to an electrodeposition treatment selected from the group consisting of electroplating and electrolytic coloring or a combination thereof.

4. A process for surface treatment of an aluminum alloy, according to claim 3, wherein the amount of sodium hydrogenphosphate, tribasic sodium phosphate, sodium citrate, sodium tartrate, sorbitol, potassium fluoride and sodium fluoride is 0.2 to 0.5 mol, 0.2 to 0.4 mol, 0.1 to 0.75 mol, 0.1 to 0.55 mol, 0.25 to 0.75 mol, 0.1 to 0.75 mol and 0.1 to 0.75 mol, respectively.

5. A process for making a decorative wheel cover using an aluminum alloy containing Si, the process comprising the steps of:

buffing a surface of the aluminum alloy;

forming an anodized film on the buffed surface by subjecting the buffed surface to an anodizing treatment using an electrolyte comprising:

(i) at least one compound containing an anion capable of coordinating as a ligand on a metal ion to form a complex during said anodizing treatment selected from the group consisting of sodium hydrogenphosphate and tribasic sodium phosphate, (ii) at least one salt of an organic acid containing an oxyacid anion selected from the group consisting of sodium citrate and sodium tartrate, or sorbitol, and (iii) at least one halide selected from the group consisting of potassium fluoride and sodium fluoride;

subjecting the anodized film to Ni plating to form a nickel plating film; and subjecting the surface of the Ni plating film to Cr plating.

6. A process according to claim 5, wherein the amount of sodium hydrogenphosphate, tribasic sodium phosphate, sodium citrate, sodium tartrate, sorbitol, potassium fluoride and sodium fluoride is 0.2 to 0.5 mol, 0.2 to 0.4 mol, 0.1 to 0.75 mol, 0.1 to 0.55 mol, 0.25 to 0.75 mol, 0.1 to 0.75 mol and 0.1 to 0.75 mol, respectively.

7. A spiral scroll member for a compressor that comprises a casing and a relatively rotating a pair of spiral scroll members, comprising:

a spiral scroll member made of an aluminum alloy containing Si; and an anodized film formed on the surface of the spiral scroll member by subjecting the spiral scroll member to an anodizing treatment using an electrolyte comprising:

(i) at least one compound containing an anion capable of coordinating as a ligand on a metal ion to form a complex during said anodizing treatment selected from the group consisting of sodium hydrogenphosphate and tribasic sodium phosphate, (ii) at least one salt of an organic acid containing an oxyacid anion selected from the group consisting of sodium citrate and sodium tartrate, or sorbitol, and (iii) at least one halide selected from the group consisting of potassium fluoride and sodium fluoride, wherein the amount of sodium hydrogenphosphate, tribasic sodium phosphate, sodium citrate, sodium tartrate, sorbitol, potassium fluoride and sodium fluoride is 0.2 to 0.5 mol, 0.2 to 0.4 mol, 0.1 to 0.75 mol, 0.1 to 0.55 mol, 0.25 to 0.75 mol, 0.1 to 0.75 mol and 0.1 to 0.75 mol, respectively.

8. A cylinder block for an internal combustion engine, comprising:

a cylinder block wherein an inner circumferential surface of a cylinder is made of an aluminum alloy containing Si;

an anodized film formed on the inner circumferential surface of the cylinder by subjecting the cylinder to an anodizing treatment using an electrolyte comprising:

(i) at least one compound containing an anion capable of coordinating as a ligand on a metal ion to form a complex during said anodizing treatment selected from the group consisting of sodium hydrogenphosphate and tribasic sodium phosphate, (ii) at least one salt of an organic acid containing an oxyacid anion selected from the group consisting of sodium citrate and sodium tartrate, or sorbitol, (iii) at least one halide selected from the group consisting of potassium fluoride and sodium fluoride, wherein the amount of sodium hydrogenphosphate, tribasic sodium phosphate, sodium citrate, sodium tartrate, sorbitol, potassium fluoride and sodium fluoride is 0.2 to 0.5 mol, 0.2 to 0.4 mol, 0.1 to 0.75 mol, 0.1 to 0.55 mol, 0.25 to 0.75 mol, 0.1 to 0.75 mol and 0.1 to 0.75 mol, respectively; and a Ni/SiC plating film provided on the anodized film.

9. A cylinder block for an internal combustion engine, according to claim 8, wherein the Si content of the anodized film is equal to or less than 8%.

10. An aluminum alloy decorative cover comprising an aluminum alloy containing Si and having a buffed surface; an anodized film formed on said buffed surface of said aluminum alloy by subjecting the buffed surface to an anodizing treatment using an electrolyte comprising:

(i) at least one compound containing an anion capable of coordinating as a ligand on a metal ion to form a complex during said anodizing treatment selected from the group consisting of sodium hydrogenphosphate and tribasic sodium phosphate, (ii) at least one salt of an organic acid containing an oxyacid anion selected from the group consisting of sodium citrate and sodium tartrate, or sorbitol, and (iii) at least one halide selected from the group consisting of potassium fluoride and sodium fluoride, wherein the amount of sodium hydrogenphosphate, tribasic sodium phosphate, sodium citrate, sodium tartrate, sorbitol, potassium fluoride and sodium fluoride is 0.2 to 0.5 mol, 0.2 to 0.4 mol, 0.1 to 0.75 mol, 0.1 to 0.55 mol, 0.25 to 0.75 mol, 0.1 to 0.75 mol and 0.1 to 0.75 mol, respectively;

a Ni plating film provided on said anodized film; and a Cr plating film provided on said Ni plating film.

11. An aluminum alloy decorative cover according to claim 10, wherein the decorative cover is a crankcase cover for a motorbike.

* * * * *